US007415230B2

(12) United States Patent
Kawamura et al.

(10) Patent No.: US 7,415,230 B2
(45) Date of Patent: Aug. 19, 2008

(54) DEVELOPING APPARATUS FEATURING AN INSULATING OR ELECTRICALLY FLOATING JUMPING DEVELOPER REGULATION MEMBER

(75) Inventors: Takeshi Kawamura, Shizuoka-ken (JP); Ken Nakagawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/865,759

(22) Filed: Jun. 14, 2004

(65) Prior Publication Data

US 2005/0008401 A1 Jan. 13, 2005

(30) Foreign Application Priority Data

Jun. 17, 2003 (JP) ..... 2003-172015
Jun. 17, 2003 (JP) ..... 2003-172016
Aug. 29, 2003 (JP) ..... 2003-307593

(51) Int. Cl.
*G03G 15/08* (2006.01)

(52) U.S. Cl. ..... 399/265; 399/266

(58) Field of Classification Search ..... 399/271, 399/55, 53, 265, 266, 290
See application file for complete search history.

(56) References Cited

U.S. PATENT DOCUMENTS 4,592,653 A * 6/1986 Ikeda et al. ..... 399/103
5,473,416 A * 12/1995 Endou et al. ..... 399/265
6,026,264 A * 2/2000 Wong et al. ..... 399/266
6,516,159 B1 * 2/2003 Sakurai ..... 399/27
6,721,527 B2 4/2004 Kanari et al. ..... 399/281
2003/0219285 A1 11/2003 Nakagawa ..... 399/281

FOREIGN PATENT DOCUMENTS

JP 03194582 A * 8/1991
JP 4-56977 A 2/1992
JP 6-11972 A 1/1994
JP 06222658 A * 8/1994
JP 7-319289 A 12/1995
JP 8-22185 1/1996
JP 8-30089 2/1996
JP 8-95373 4/1996
JP 8-220853 A 8/1996

(Continued)

OTHER PUBLICATIONS

Computer translation of JP09-106181A.*

(Continued)

*Primary Examiner*—Quana M Grainger
(74) *Attorney, Agent, or Firm*—Fitzpatrick, Cella, Harper & Scinto

(57) ABSTRACT

A developing apparatus includes a developer carrying member, disposed opposite to an image bearing member, for carrying developer which is caused to jump from the developer carrying member to the image bearing member to develop an electrostatic latent image formed on said image bearing member by creating an oscillation electric field between the image bearing member and the developer carrying member at an opposing portion where the image bearing member and the developer carrying member are opposed to each other; and a jumping developer regulation member for regulating an area in which the developer is caused to jump in the opposing portion. The jumping developer regulation member is disposed apart from the developer carried by the developer carrying member and is an insulating member or an electrically floating member.

63 Claims, 18 Drawing Sheets

FOREIGN PATENT DOCUMENTS

| | | | | |
|---|---|---|---|---|
| JP | 09106181 | A | * | 4/1997 |
| JP | 10-111601 | A | | 4/1998 |
| JP | 11223991 | A | * | 8/1999 |
| JP | 2005-10271 | | | 1/2005 |
| JP | 2005-10272 | | | 1/2005 |
| JP | 2005-77702 | | | 3/2005 |

OTHER PUBLICATIONS

Computer translation of cited reference JP06-011972A.*

* cited by examiner

DEVELOPING APPARATUS FEATURING AN INSULATING OR ELECTRICALLY FLOATING JUMPING DEVELOPER REGULATION MEMBER

FIELD OF THE INVENTION AND RELATED ART

The present invention relates to a developing apparatus in which an oscillation electric field is created between an image bearing member and a developer carrying member at an opposing portion where the image bearing member and the developer carrying member are opposed to each other, whereby developer is caused to jump from the developer carrying member to the image bearing member to effect development. The developing apparatus is suitable for the use of a nonmagnetic monocomponent developer and is preferably used in an image forming apparatus utilizing an electrophotographic scheme or an electrostatic recording scheme.

As a laser beam printer or a copying machine, an image forming apparatus using an electrophotographic process as shown in FIG. 14 has been conventionally proposed. A basic operation of the image forming apparatus will be described hereinbelow.

An electrophotographic photosensitive member 11 ordinarily having a drum shape as an image bearing member (hereinafter referred to as a "photosensitive drum") is electrically charged uniformly by a primary charger 12. Then, in correspondence with image information inputted from an external apparatus, the photosensitive drum 11 is subjected to light irradiation by an exposure apparatus 13 to form thereon an electrostatic latent image. This electrostatic latent image on the photosensitive drum 11 is developed with developer having a triboelectric polarity identical to that of an applied voltage from the primary charger 12 (hereinafter referred to as "toner") by a developing apparatus 60 to provide a visual image, i.e., a toner image. The toner image is transferred onto a transfer material Q by a transfer charger 14. The transfer material Q is separated from the photosensitive drum 11 and conveyed to a fixing apparatus 16 by which the toner image is fixed to provide a permanent image. Toner (developer) T, remaining on the photosensitive drum 11, which is not transferred onto the photosensitive drum 11 by the transfer charger 14, is removed by a cleaning apparatus 15 to be subjected to a subsequent image forming process.

The toner T is a negatively chargeable nonmagnetic monocomponent toner containing any one of respective color toners of yellow, magenta, cyan and black. With respect to a stirring member, a first toner stirring member 64 and a second toner stirring member 65 each comprising a plate-like member or a screw, formed in various shapes, are present and rotated in a direction of an arrow indicated in FIG. 14. The stirring members feed the toner T in a toner containing portion toward a developing roller 61 as a developer carrying member. The number of the stirring member is not limited to two but may be appropriately changed so long as the stirring member(s) can convey the toner from an end portion of a developer container to the vicinity of the developer carrying member in correspondence with structures of various developing apparatuses.

In FIG. 14, a developer container partition wall 66 has an optimized height in order to always supply a certain amount of toner onto a developer supply/scraping roller 62 disposed in the vicinity of the developing roller 61.

In a nonmagnetic monocomponent developing method, it is impossible to supply the toner by a magnetic force, so that an urethane sponge-made developer supply/scraping roller 62 is abutted against the developing roller 61. The developer supply/scraping roller 62 is rotated in a direction opposite from a rotation direction of the developing roller 61 at a nip portion therebetween, thereby to supply the toner T onto the developing roller 61 and scrape the toner T, on the developing roller 61, which has not been subjected to development each after being passed through a position opposite to the photosensitive drum, at the same time.

On the developing roller 61, a regulation blade 63 as a toner amount regulation member is abutted and regulates the amount of toner on the developing roller 61 to form thin toner layer, thus determining an amount of toner conveyed to a developing zone (a position opposite to the photosensitive drum). The amount of toner conveyed to the developing zone is determined by, e.g., an abutting pressure or an abutment length of the regulation blade 63 contacting the developing roller 61.

The regulation blade 63 is bonded or welded onto a thin metal plate of, e.g., phosphor bronze or stainless steel, having a thickness of several hundred μm. The regulation blade 63 is a tip blade which uniformly abuts against the developing roller 61 by an elasticity of the thin metal plate. An abutting condition of the regulation blade 63 is determined by a material, a thickness, an entering amount which is a depth through which the thin metal plate enters a phantom shape of the developing roller, and a set angle of the thin metal plate.

Further, the developing roller 61 is opposed to the photosensitive drum 11 surface with a predetermined gap (hereinafter referred to as an "SD gap") in a developing zone 70 and creates an oscillation electric field by applying thereto a bias voltage.

In the above structure, the toner T conveyed into the developing zone 70 in a state that it has a desired charge amount and a desired layer thickness and is deposited on the developing roller surface, visualizes the electrostatic latent image formed on the photosensitive drum surface by its reciprocating motion between the developing roller 61 and the photosensitive drum 11 under application of the alternating electric field described above.

In the developing apparatus effecting development by the oscillation electric field, such a problem that image failure called "downstream concentration" is caused to occur has been known. In order to solve the downstream concentration problem, a Japanese Laid-Open Patent Application (JP-A) Hei 8-22185 has been proposed.

Hereinbelow, with reference to FIG. 15, the downstream concentration phenomenon will be described.

FIG. 15 is a model view of the photosensitive drum 11 and the developing roller 61 as seen in their longitudinal direction.

The downstream concentration is such a phenomenon that a large amount of toner is concentrated at a trailing end portion of an image as indicated by H in FIG. 15. When such an image is formed, image failure such that a larger image density portion is observed in the resultant image is caused to occur.

As shown in FIG. 15, when an AC bias voltage is applied between the photosensitive drum 11 and the developing roller 61, a barrel-shaped electric field is created. In the gap between the photosensitive drum 11 and the developing roller 61, the toner is caused to jump perpendicularly from the developing roller surface by an electric field directed in one of two directions. The developing roller has a curved surface, so that the toner is caused to jump by the action of acceleration in a direction apart from a closest portion other than the closest portion. When the toner comes near the photosensitive drum and the direction of the electric field is changed, the toner is further accelerated in a direction perpendicular to the photosensitive drum surface to be moved in a direction further apart from the closest portion. A locus of such a toner is shown in FIG. 15. In other words, the electric field acts on the toner so that the toner located upstream from the closest portion in the gap between the photosensitive drum and the developing roller is moved toward a further upstream side and that located downstream from the closest portion is moved toward a further downstream side.

The toner deposited on the developing roller surface is reciprocated between the photosensitive drum 11 and the developing roller 61 along electric line of force created by the electric field, so that the toner is moved outward with respect to a closest position S between the photosensitive drum 11 and the developing roller 61. In other words, when the AC bias voltage is applied, the toner T has a component of velocity always moved in a direction toward outside the developing zone.

Next, the case where the photosensitive drum 11 and the developing roller 61 are rotated in the directions of arrows indicated in FIG. 15, i.e., the case where an actual development is performed, will be described. In the figure, a position at a potential of −100 V represents a latent image portion (a light-part potential portion on which the toner is deposited), i.e., a toner image forming area. On the other hand, a position at a potential of −500 V represents a reference potential portion (a dark-part potential portion on which the toner is not deposited), i.e., an area where the toner image is not formed. When the latent image portion reaches the developing zone, the toner on the developing roller is deposited on the latent image portion but a part of the toner is moved on the upstream side of the latent image portion since jumping toner T1 has the component of velocity moved outside the developing zone as described above. Further, at a boundary between the positions of −100 V and −500 V, an electric field directed from the position of −500 V toward the position of −100 V is created, whereby the toner T1 moved toward the upstream side of the latent image portion is stopped at the boundary. For this reason, an amount of toner at the rear end portion in the latent image portion is increased compared with those at the downstream and central portions. As a result, a downstream concentration portion H of the toner, i.e., a portion where the toner amount is increased at the image rear end portion, is created.

JP-A Hei 8-22185 described above for reducing the downstream concentration image has employed a method using a plate-like electrode member disposed between the photosensitive drum and the developing roller. However, this method is not sufficient to prevent the downstream concentration. Particularly, in a developing apparatus using a nonmagnetic monocomponent developer, the downstream concentration phenomenon is caused to occur in some cases.

Further, JP-A Hei 8-30089 and JP-A Hei 8-95373 has also disclosed such a structure that a plate-like electrode member is provided in a developing zone for the purpose of controlling jumping of developer.

In the above described three Japanese Laid-Open Applications, a bias voltage applied to a developer carrying member is leaked out to a latent image bearing member in some cases in an environment, that a surface resistance of the plate-like electrode member is lowered, e.g., in a high temperature/high humidity environment.

SUMMARY OF THE INVENTION

An object of the present invention is to provide a developing apparatus which is provided through a simple process, excellent in environmental adaptability, and stably used until its operating life.

Another object of the present invention is to provide a developing apparatus capable of reducing an occurrence of image failure causing an increase in image density at an image trailing end portion.

A further object of the present invention is to provide a developing apparatus capable of suppressing current leakage to an image bearing member along the surface of a developer regulation member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, embodiments of the present invention will be described with reference to the drawings.

Embodiment 1

Figure 1:
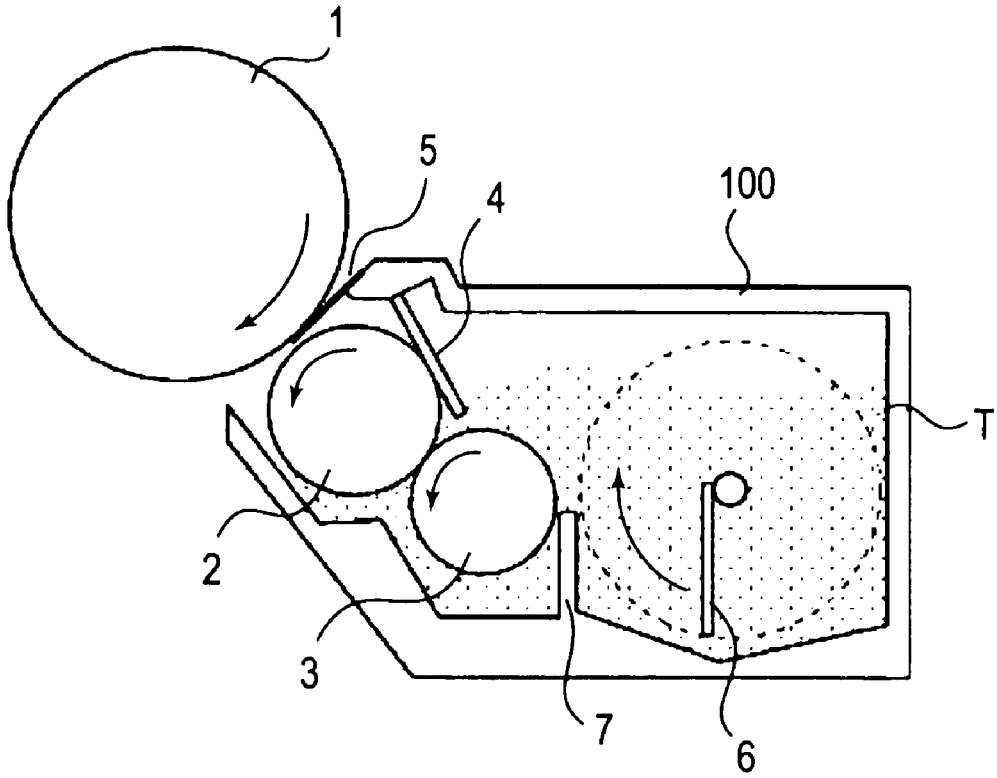
FIG. 1 is an explanatory of a structure of a developing apparatus according to an embodiment of the present invention.

A developing apparatus according to this embodiment is shown in FIG. 1.

A developing apparatus 100 shown in FIG. 1 includes a developing device of a nonmagnetic monocomponent noncontact development type.

Figure 14:
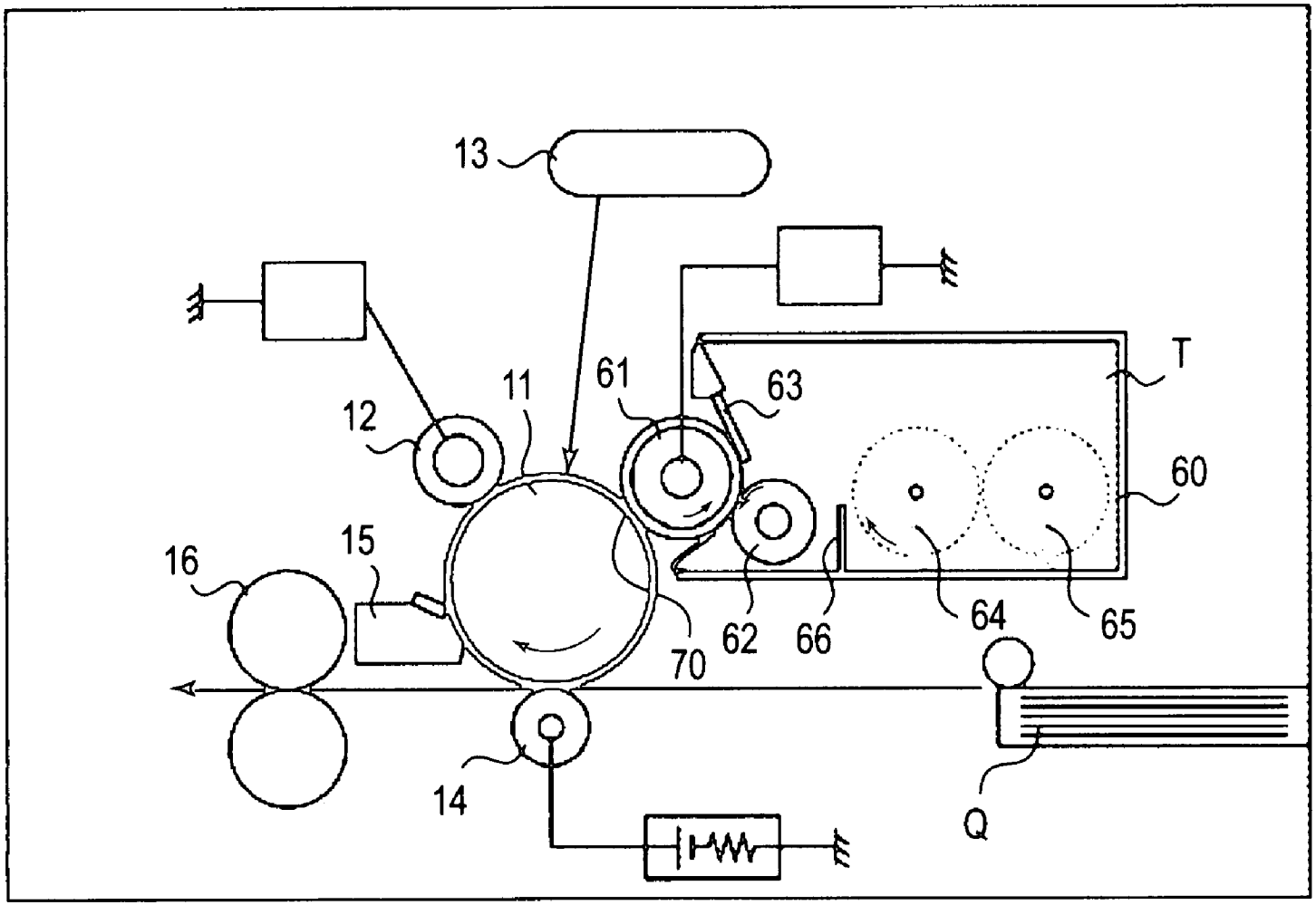
FIG. 14 is a schematic structural view of a conventional electrophotographic apparatus.
Figure 15:
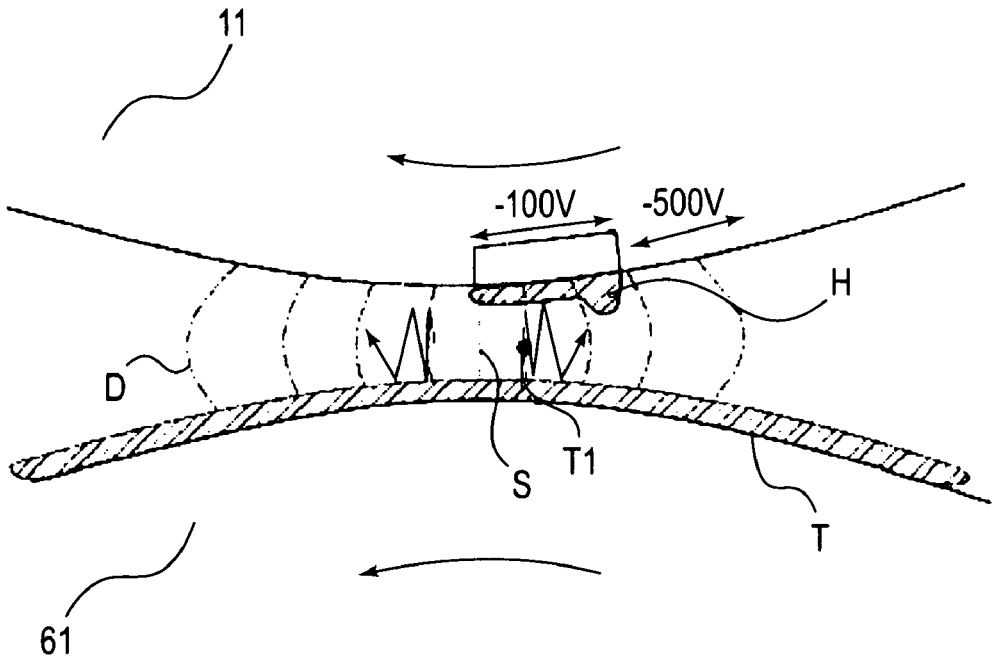
FIG. 15 is a view for illustrating a downstream concentration image.

With respect to structural members other than the developing apparatus for an image forming apparatus, those for the image forming apparatus shown in FIG. 14 are applicable, so that explanation therefor will be omitted.

Hereinafter, the developing apparatus 100 will be described in detail.

In FIG. 1, there are present a photosensitive drum 1 as an image bearing member, a developing roller (developing sleeve) 2 as a developer carrying member, a developer supply/scraping roller 2 a a developer supply member, a toner amount regulation member 4, a jumping developer control member 5 as a jumping developer regulation member for regulating an area wherein developer is caused to jump, toner T as nonmagnetic monocomponent developer, and a plate-like toner stirring member 6.

As the photosensitive drum 1, a member prepared by coating a surface of a 30 mm-diameter bear aluminum tube with a photosensitive material such as an organic photoconductor (OPC) was used. As a developing roller 2, a member prepared by spray-coating a surface of a 16 mm-diameter aluminum crude pipe with a phenolic resin solution containing carbon and graphite dispersed therein was used. At both end portions of the developing roller 2, SD (sleeve-drum) rollers are disposed and abutted against the photosensitive drum 1 surface to keep an SD gap of 300 μm. As the developer supply/scraping roller 3, a member prepared by forming a 4.5 mm-thick urethane foam at an outer peripheral surface of a 5 μm-diameter core metal was used. As the toner amount regulation member 4, a 0.1 mm-thick phosphor bronze plate was used.

An operation of the developing apparatus 100 will be described.

The toner T is negatively chargeable nonmagnetic monocomponent toner. The toner stirring member 6 is disposed so as to be rotatable in a direction of an arrow indicated in FIG. 1 and feeds the toner T in a toner containing portion toward the developing roller 2. In the figure, a reference numeral 7 represents a developer container partition wall which has an optimized height in order to always supply a certain amount of toner onto the developer supply/scraping roller 3 located in the vicinity of the developing roller 2.

The developer supply/scraping roller is abutted against the developing roller 2 and rotated in a direction opposite from a rotation direction of the developing roller 61 at a nip portion therebetween, thereby to supply the toner T onto the developing roller 2 and scrape the toner, on the developing roller 2, which has not been subjected to development even after being passed through a position opposite to the photosensitive drum 1, at the same time.

Against the developing roller 2, a regulation blade 4 as the toner amount regulation member is abutted and regulates the amount of toner on the developing roller 2 to form a thin toner layer, thus determining an amount of toner conveyed to a developing zone and electrically charge the toner at the same time.

In the above structure, the toner conveyed into the developing zone in a state that it has a desired charge amount and a desired layer thickness and is deposited on the developing roller surface, visualizes an electrostatic latent image formed on the photosensitive drum surface by its reciprocating motion between the developing roller and the photosensitive drum under application of a developing bias voltage applied to the developing roller. As the developing bias voltage, a voltage which comprises an AC voltage biased or superposed with a DC voltage and is set so as to create an oscillation electric field between the photosensitive drum and the developing roller, is used. More specifically, the developing bias voltage is set so that its maximum value Vmax is larger than a dark-part (non-image part) potential of the photosensitive drum and its minimum value Vmin is smaller than a light-part (image part) potential of the photosensitive drum.

Various set conditions for the developing roller 100 will be described.

The photosensitive drum 1 is rotated in a direction of an arrow indicated (inside the drum) in FIG. 1, and the developing roller 2 is rotated in a direction of an arrow indicated (inside the roller) in FIG. 1. As the developing bias voltage, a voltage comprising an AC bias voltage (peak-to-peak voltage: 2 kV, AC frequency=3 kHz) biased with a DC bias voltage of −260 V, was used. In order to provide a uniform thin toner layer as a surface layer of the developing roller, the toner (amount) regulation member 4 is pressed against the developing roller 2 at a linear pressure of 30 g/cm in a direction opposite from the rotation direction of the developing roller 2.

The jumping developer control member 5 will be described with reference to FIG. 2.

Figure 2:
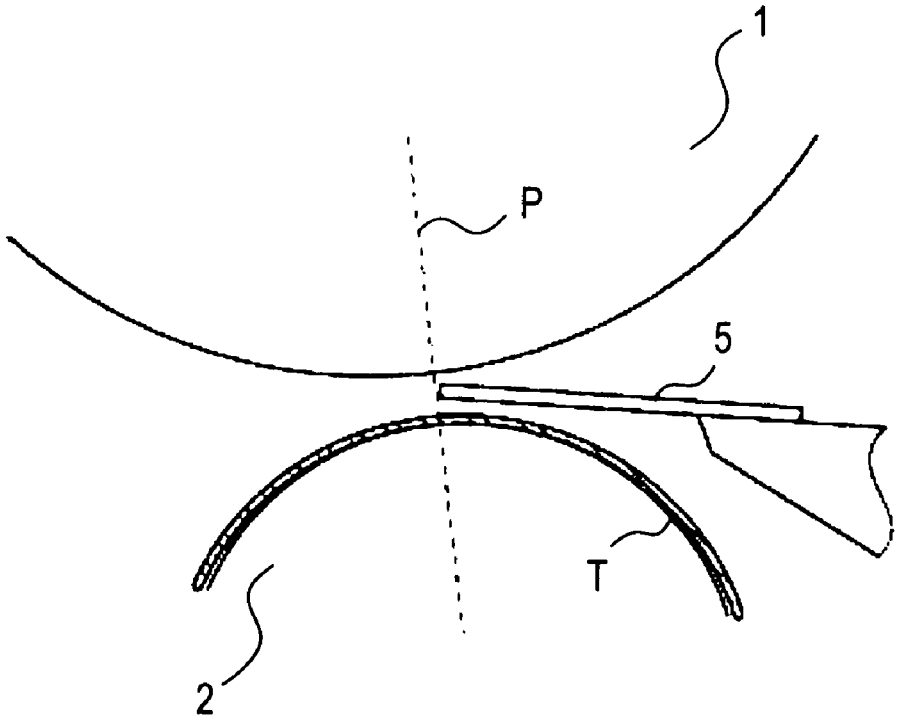
FIG. 2 is an enlarged explanatory view showing a developing zone and its vicinity in Embodiment 1 of the present invention.

FIG. 2 is an enlarged view showing the developing zone and its vicinity in the developing apparatus of this embodiment. The jumping developer control member 5 is disposed so that its free end enters the vicinity of a line P connecting rotation centers of the photosensitive drum 1 and the developing roller 2, thus controlling jumping of the developer. In this embodiment, the jumping developer control member 5 is disposed in a noncontact manner with respect to not only the photosensitive drum 1 but also the developing roller 2. Further, the jumping developer control member 5 is also disposed so that it does not contact the developer carried on the developing roller 2. The jumping developer control member 5 is, e.g., an insulating resin sheet.

Herein, the developing zone is defined and measured in the following manner.

In the above described developing apparatus, an AC bias voltage sufficient to cause the toner on the developing roller 2 to jump is applied to the developing roller 2 in such a state that the electrically charged toner is deposited on the developing roller surface and both of the photosensitive drum 1 and the developing roller 2 are stopped. This AC bias voltage may be the developing bias voltage applied to the developing roller 2 at the time of ordinary development and is set to provide an image density of 1.4 in terms of Macbeth density when a solid black (whole black) image is formed on the photosensitive drum 1.

Figure 3:
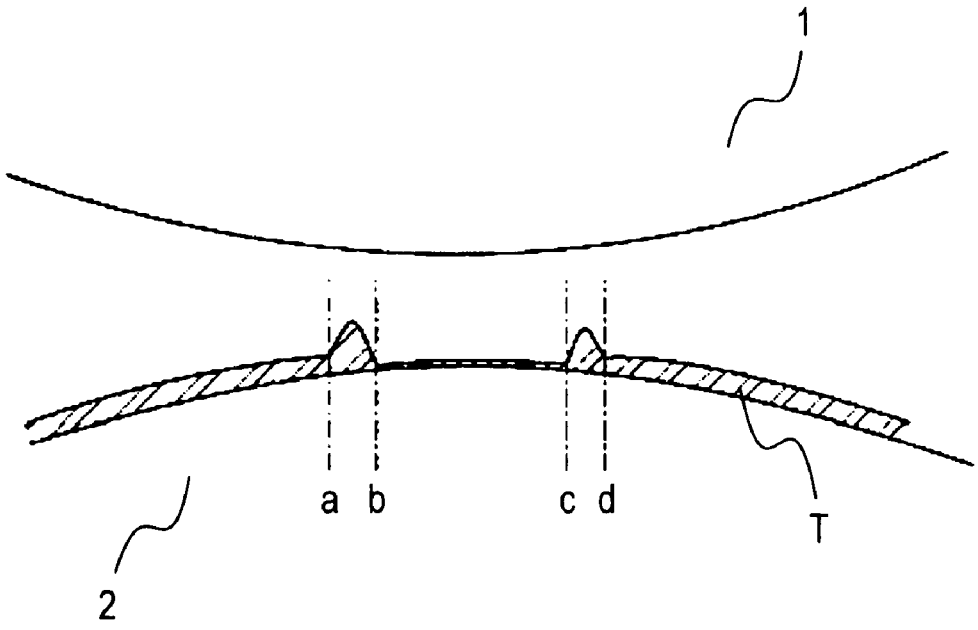
FIG. 3 is a view for illustrating a definition of the developing zone in the present invention.

At that time, there are a less toner zone in which no or thinner toner layer is formed compared with its surrounding zone, and much toner zones, adjacent to the less toner zone, in which a thicker toner layer is formed. A model view for illustrating such a state is shown in FIG. 3. In FIG. 3, zones between a and B and between c and d are the much toner zones, and a zone between b and c is the less toner zone. Herein, the zone between a and d is referred to as a "developing zone". The developing zone is determined through measurement under conditions including an average charge amount of toner, on the developing roller, of 40 μC/g; a toner deposition amount per unit area, on the developing roller, of 0.5 mg/cm$^2$; an AC bias voltage application time of 1 sec in an environment of 1 atmospheric pressure/20° C. (temperature)/60% RH (humidity).

A width (a length between a and d) of the developing zone varies depending on diameters of the photosensitive drum 1 and the developing roller 2; an SD gap; environmental conditions, such as temperature, humidity, and atmospheric pressure; a developing bias voltage; an application time of the developing bias voltage; a charge amount of toner; and a deposition amount of toner on the developing roller.

According to our experiment, the developing zone (width) was 4 mm when an AC bias voltage (frequency: 2500 Hz, peak-to-peak voltage: 2000 V) is applied for 1 sec between the photosensitive drum and the developing roller in an environment (1 atmospheric pressure, 20° C., 60% RH) under conditions including a diameter of photosensitive drum of 30 mm, a diameter of developing roller of 16 mm, an SD gap of 300 μm, an average charge amount of toner (on the developing roller) of 40 μC/g, and a toner deposition amount per unit area (on the developing roller) of 0.5 mg/cm$^2$.

A set position of the jumping developer control member 5 in this embodiment will be described.

First of all, a downstream concentration image and its evaluation method are described.

Figure 4:
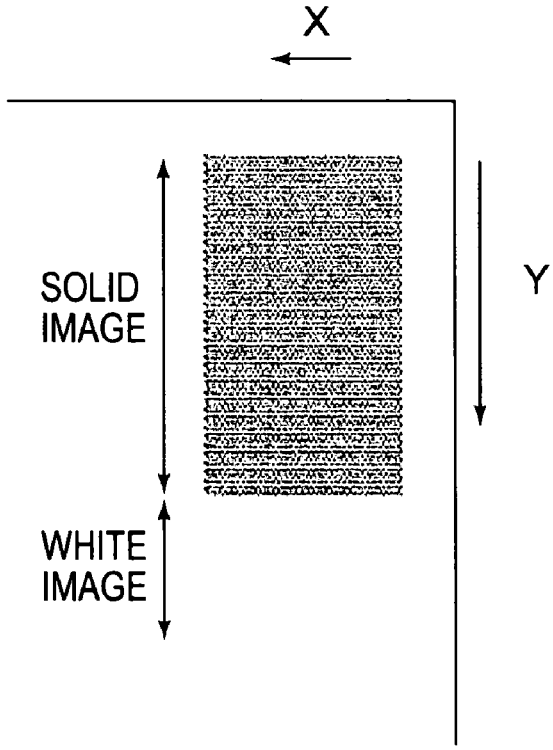
FIG. 4 is an explanatory view of a sample image for illustrating downstream concentration in embodiments of the present invention.

The downstream concentration phenomenon is more conspicuous as a potential difference of latent image on the photosensitive drum becomes larger. For example, it is conspicuous in the case of such an image comprising a solid black image and a subsequent solid white image. FIG. 4 is a part of an image pattern used for evaluating an effect of the present invention. An X coordinate represents a rotation axis direction (longitudinal direction) of the photosensitive drum, and a Y coordinate represents a rotation direction of the photosensitive drum (a movement direction of transfer material).

Figure 5:
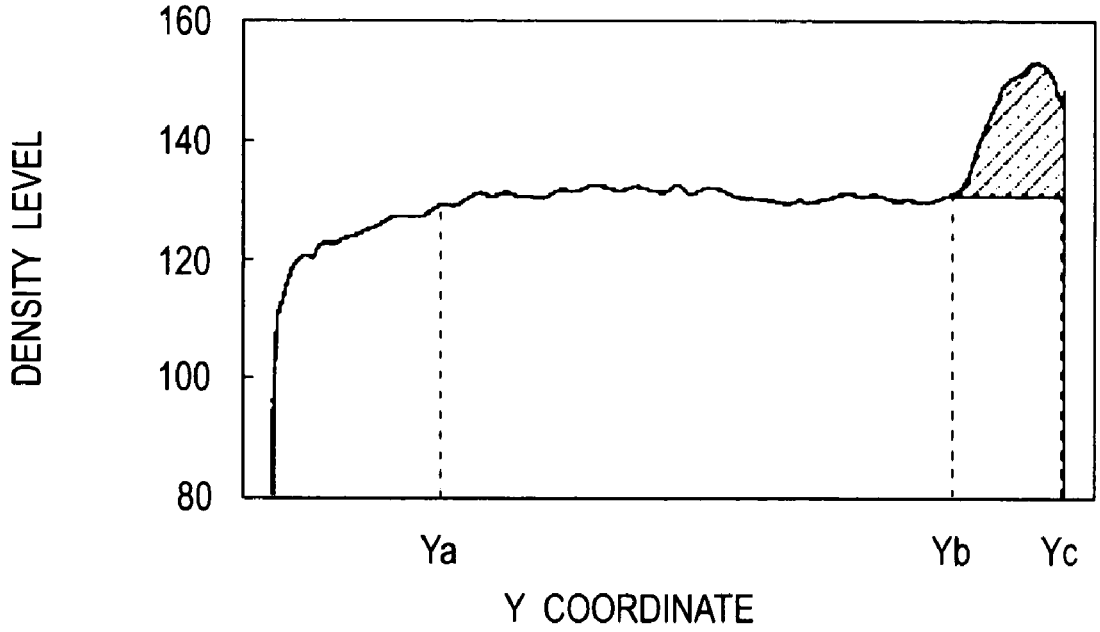
FIG. 5 is a graph for illustrating a manner of converting a degree of downstream concentration into a numerical value.

This image pattern includes an image comprising a solid black image (length: 30 mm, width: 20 mm and a subsequent solid white image). This image is scanned in a personal computer (PC) through an image scanner system, and an image density is converted into a numerical datum (density level) between 0 and 255. FIG. 5 shows a density distribution of the sample image with respect to the Y coordinate.

Next, a method of converting the image density at the downstream concentrated portion into a numerical value is described.

Referring to FIG. 5, the density level in a range from Yb to Yc is larger than that in a range from Ya to Yb. In other words, the range from Yb to Yc corresponds to a downstream concentration area. A hatched line portion is FIG. 5 corresponds to an integral value of the density level of the downstream concentrated portion, and a density level change per 1 mm is determined as a downstream concentration level. In the case of downstream concentration data shown in FIG. 5, a value of the downstream concentration area between Yb and Yc is 4 (mm), and an integrated value of the density level (the hatched portion in FIG. 5) is 160. Accordingly, a downstream concentration level is 160/4=40.

According to our experiment, when the downstream concentration level is not more than 20, the downstream concentration phenomenon through human eye observation becomes less conspicuous. In the present invention, an image providing a downstream concentration level of not more than 20 is a good image.

Figure 6:
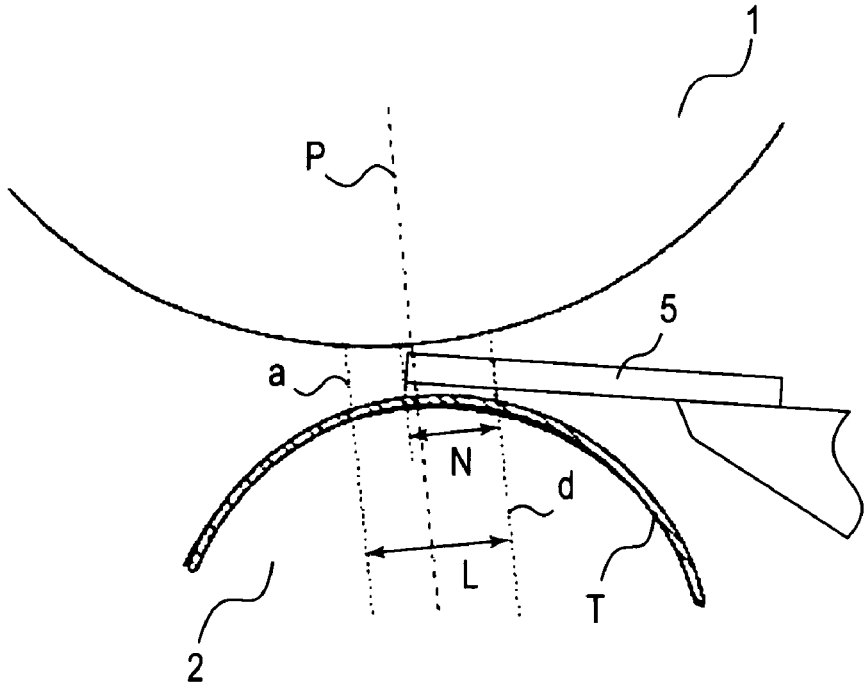
FIG. 6 is a model view for illustrating the developing zone in an embodiment of the present invention.

FIG. 6 is an enlarged view showing a developing zone and its vicinity in this embodiment. A range from point a to point d is the developing zone and its length is taken as L. A range from a position of a free end of the jumping developer control member 5 to the point d is a developing zone entering amount of the jumping developer control member 5, i.e., a length from an upstream end position d of the developing zone to the free end position of the jumping developer control member 5 in the movement direction of the photosensitive drum 1, is taken as N. In FIG. 6, the jumping developer control member 5 is disposed so as not to contact not only the photosensitive drum 1 but also the toner T on the developing roller 2.

Figure 7:
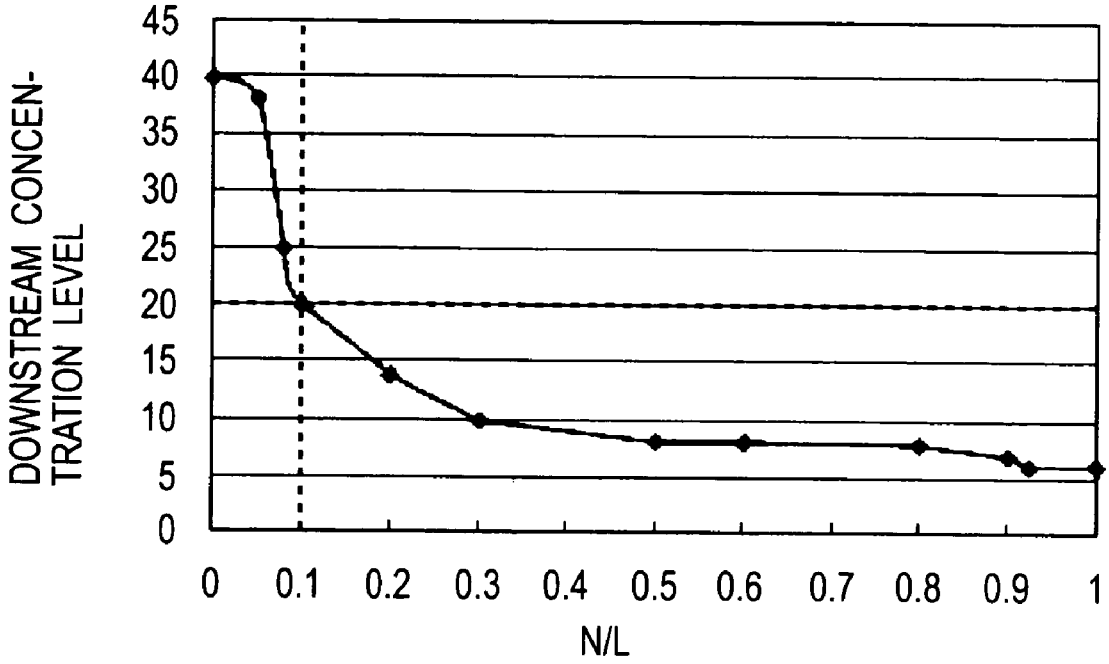
FIG. 7 is a graph showing a relationship between a downstream concentration level and an N/L ratio in an embodiment of the present invention.

FIG. 7 shows the progression of downstream concentration level when a value of N/L (ratio) is changed. As shown in FIG. 7, the downstream concentration level becomes not more than 20 at the N/L ratio of not less than 0.1, thus providing a good image.

Figure 8:
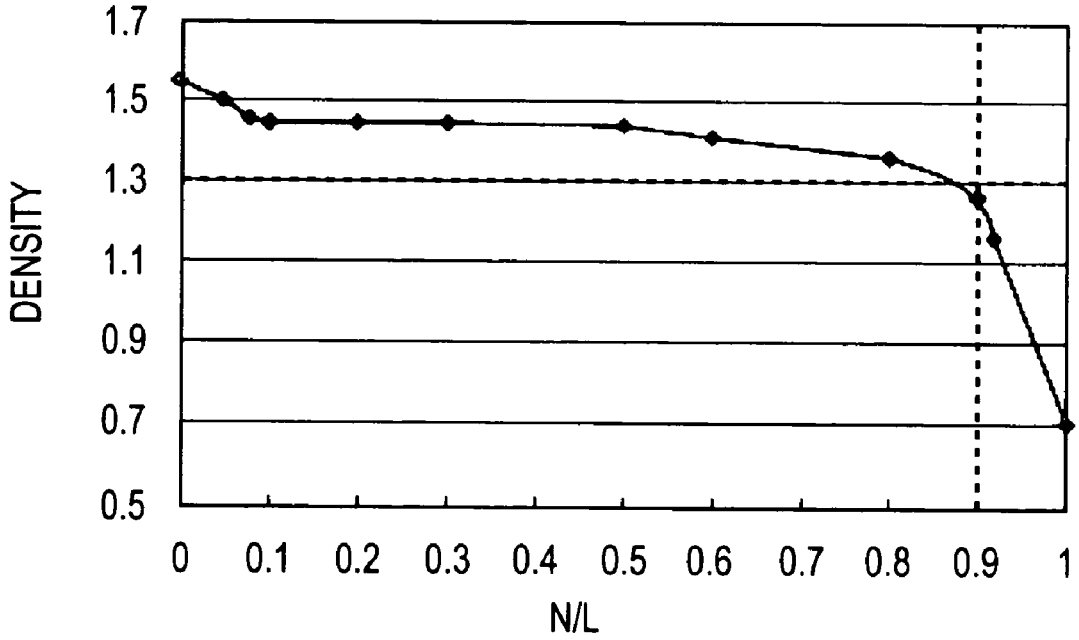
FIG. 8 is a graph showing a relationship between a sample image density and an N/L ratio in an embodiment of the present invention.

FIG. 8 shows the progression of image density of the solid black image when the N/L ratio is changed. Measurement of the image density is performed by using a Macbeth densitometer ("Macbeth Series 1200"). As shown in FIG. 8, when the N/L ratio exceeds 0.9, the resultant image density is lowered. In other words, by disposing the jumping developer control member 5 so as to satisfy the relationship: $0.1 \leqq N/L \leqq 0.9$, it is possible to minimize the downstream concentration.

When the downstream concentration level is not more than 10 (the N/L ratio of not less than 0.3 in FIG. 7), the downstream concentration cannot be observed by the human eye. Further, at the solid image density (Macbeth density) of not less than 1.4 (at the N/L ratio of not more than 0.6), it is possible to obtain a good image even in an environment, in which it is difficult to cause the toner to jump, such as a low temperature/low humidity environment. Accordingly, it is desirable that the jumping developer control member 5 is disposed to satisfy the relationship: $0.3 \leqq N/L \leqq 0.6$.

Hereinbelow, the effects of the present invention will be described based on Comparative Embodiment 1.

Comparative Embodiment 1

A developing apparatus in this embodiment is a developing apparatus using a two component developer described in JP-A Hei 8-22185, wherein a voltage is applied to an electrode portion of a control electrode plate (jumping developer control member). To a developing sleeve, a bias voltage comprising a DC component biased with an AC voltage is applied, and to the electrode portion of the control electrode plate, a bias voltage consisting only of a DC component is applied. By doing so, a first oscillation electric field is created between the electrode portion and the developing sleeve and a second oscillation electric field is created between the photosensitive drum and the developing sleeve. Structures and operations of the developing apparatus and other members in this comparative embodiment are omitted from explanation.

Figure 9:
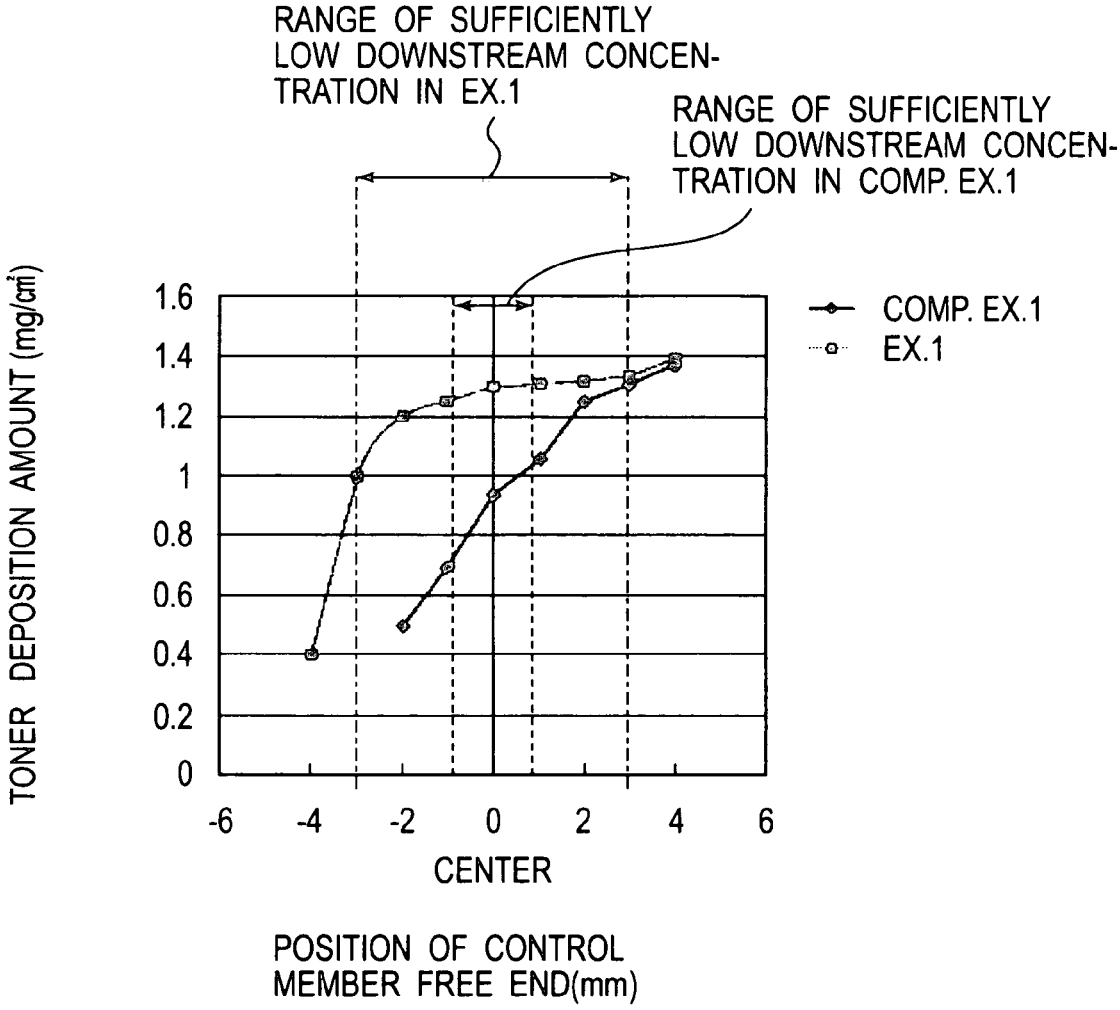
FIG. 9 is a graph showing a relationship between a free end position of jumping developer control member and a deposition amount of toner on a photosensitive drum in Embodiment 1 of the present invention and Comparative Example 1.

FIG. 9 shows a relationship between a toner deposition amount of solid black image on the photosensitive drum and a free end position of the control electrode plate in the developing apparatus (using the two component developer) of Comparative Embodiment 1 and a relationship between a toner deposition amount of solid black image on the photosensitive drum and a free end position of the jumping developer control member in the developing apparatus (using the monocomponent developer) in Embodiment 1. In the figure, "CENTER" means a closest position between the photosensitive drum and the developing roller. The plus (+) side on the abscissa is an upstream side from the closest position in the photosensitive drum rotation direction, and the minus (−) side is a downstream side from the closest position in the photosensitive drum rotation direction.

As shown in FIG. 9, in Comparative Embodiment 1, the toner deposition amount started to decrease when the free end position of the control electrode plate was about +3 mm from the CENTER, and a range of the free end position wherein the toner deposition amount was further decreased by about 20% to about 30% thereof, was a range of sufficiently low downstream concentration. At that time, a corresponding potential range of the free end of the control electrode plate was within ±1 mm from the CENTER. On the other hand, in the present invention (Embodiment 1), a range of sufficiently low downstream concentration started from a position (+3 mm from the CENTER) where the toner deposition amount was not substantially decreased. Further, the toner deposition amount started to decrease from the free end position (of the jumping developer control member) of about −1 mm from the CENTER.

In Comparative Embodiment 1, the oscillation electric field is created between the electrode member and the developing roller. For this reason, the toner is deposited on a side surface, of the control electrode plate, facing the photosensitive drum, so that the downstream concentration image can be decreased only after the free end position of the control electrode plate enters the vicinity of the CENTER to decrease an amount of toner deposited on the photosensitive drum. On the other hand, in Embodiment 1 of the present invention, the toner forming the downstream concentrated portion is suppressed, so that it is possible to sufficiently lower the downstream concentration even in a zone in which the amount of toner deposited on the photosensitive drum is not changed.

Further, in Comparative Embodiment 1, the bias voltage was applied to the electrode, so that a discharge phenomenon was caused to occur between the photosensitive drum and the developing roller through the electrode member in a low atmospheric pressure environment, thus leading to image failure. More specifically, at an atmosphere pressure of 70 kPa, a leakage electric field was 3.2 V/μm. On the other hand, a leakage electric field at the atmospheric pressure of 70 kPa in Embodiment 1 was 5.5 V/μm.

Further, the structure wherein the jumping developer control member is provided with an electrode to which a voltage is applied, is placed in a state that a strong electrostatic force is exerted between the electrode and the developing roller, thus leading to increase in vibration of the jumping developer control member and development noises. As a result, in the structure of Comparative Embodiment 1, jitter is liable to occur at an abutting portion of the jumping developer control member with the photosensitive drum or the developing roller. When the jitter is caused to occur, the developer is caused to be moved onto the surface of the jumping developer control member opposite to the photosensitive drum, thus undesirably lowering a downstream concentration image prevention effect. For this reason, as in Embodiment 1 of the present invention, such a structure that the jumping developer control member is formed of an insulating material and is not provided with an electrode or is provided with an electrode which is, however, not supplied with a voltage, i.e., is placed in an electrically floating state, is preferable. Even if the jumping developer control member is provided with the electrode, the electrode is placed in the electrically floating state at least at the time of development.

Embodiment 2

Figure 10:
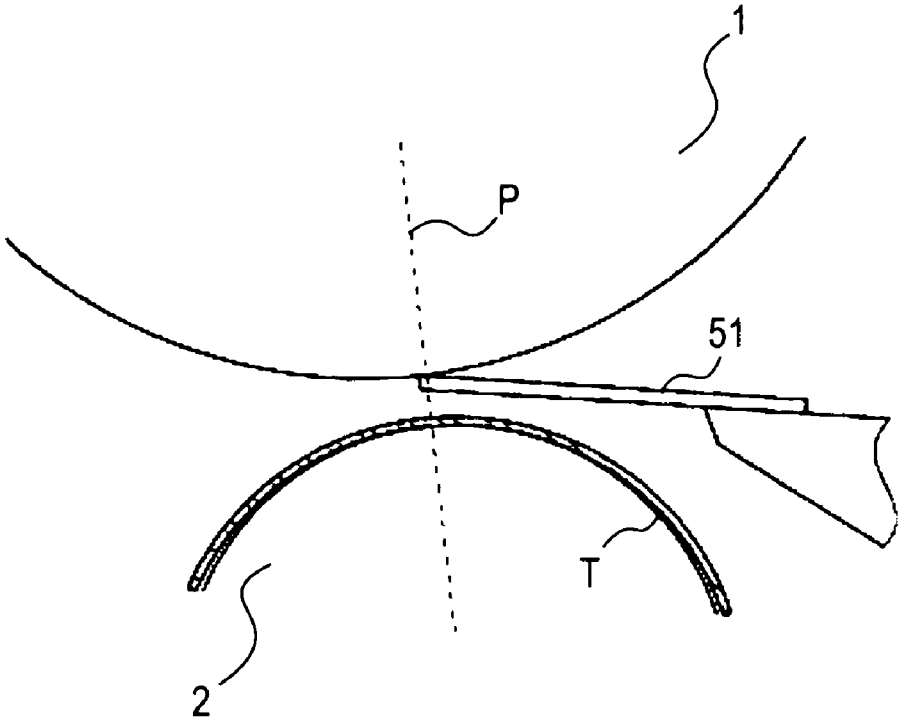
FIGS. 10-13 are respectively an enlarged explanatory view showing a developing zone and its vicinity in another embodiment of the present invention.

FIG. 10 shows a schematic structural view of a developing apparatus in this embodiment.

With respect to structures and operations, members or means identical to those used in Embodiment 1 are represented by identical reference numerals or signs and explanation therefor is omitted.

As features of Embodiment 2, a jumping developer control member 51 is an elastic sheet and is disposed so as not to contact a toner coating layer on the developing roller 2 in the developing zone. Further, the jumping developer control member 51 is in contact with the photosensitive drum 1 in the developing zone.

The jumping developer control member 51 is required to be accurately inserted into the SD gap of 300 μm. In this embodiment, the elastic sheet is used as the jumping developer control member 51 is brought into contact with the photosensitive drum 1 under pressure, whereby it becomes possible to accurately set the free end position of the jumping developer control member 51 to a desired position.

Comparative Embodiment 2

Figure 11:
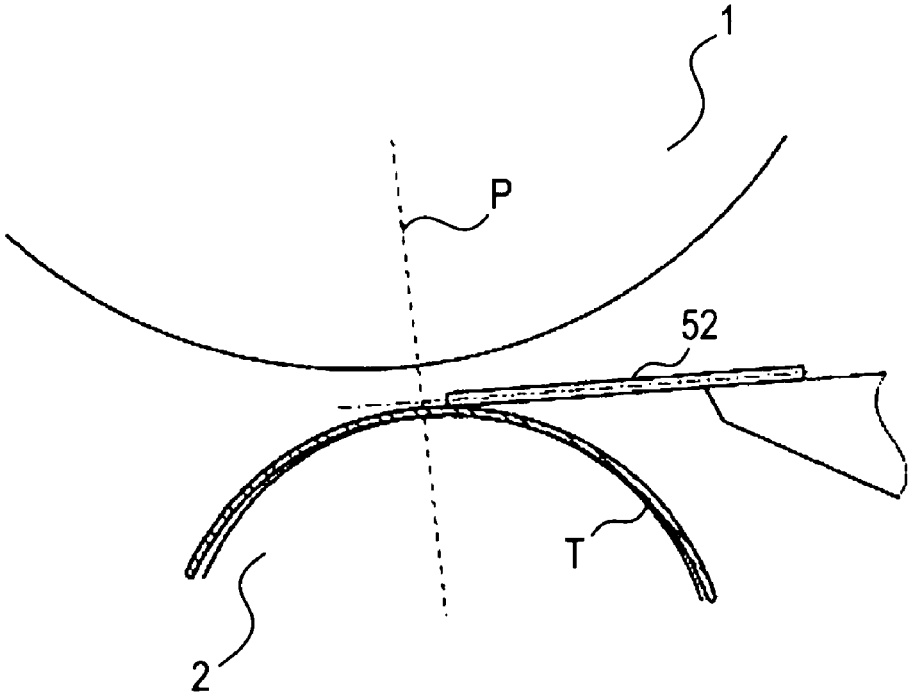

FIG. 11 is an enlarged view of a developing zone and its vicinity in this comparative embodiment. As shown in FIG. 11, a free end of a jumping developer control member 52 contacts the toner T deposited on the developing roller 2 but does not contact the photosensitive drum 1, and is otherwise similar to Embodiment 1.

In Comparative Embodiment 2, the jumping developer control member 52 contacts the toner layer on the developing roller in the developing zone, so that the jumping developer control member 52 is liable to disturb the toner coating state on the developing roller when compared with the cases of Embodiments 1 and 2. Particularly, in the monocomponent development scheme, the disturbance of the toner coating state causes image failure in which the toner coating state is reflected. Further, when an image forming operation is repetitively performed, the toner caused to jump is moved onto the side surface of the jumping developer control member 52 facing the photosensitive drum. Then, the moved toner reciprocates between the photosensitive drum 1 and the jumping developer control member 52, so that the downstream concentration image is liable to occur when compared with the cases of Embodiments 1 and 2. Further, in some cases, such an image defect, called fog, that the toner is deposited in an area other than the latent image area on the photosensitive drum 1, is caused to occur.

On the other hand, the developing apparatuses of Embodiments 1 and 2 includes the jumping developer control members is so disposed as not to contact the toner layer on the developing roller 2, so that it becomes possible to prevent the downstream concentration image without causing the above described image defect as compared with Comparative Embodiment 2.

Embodiment 3

Figure 12:
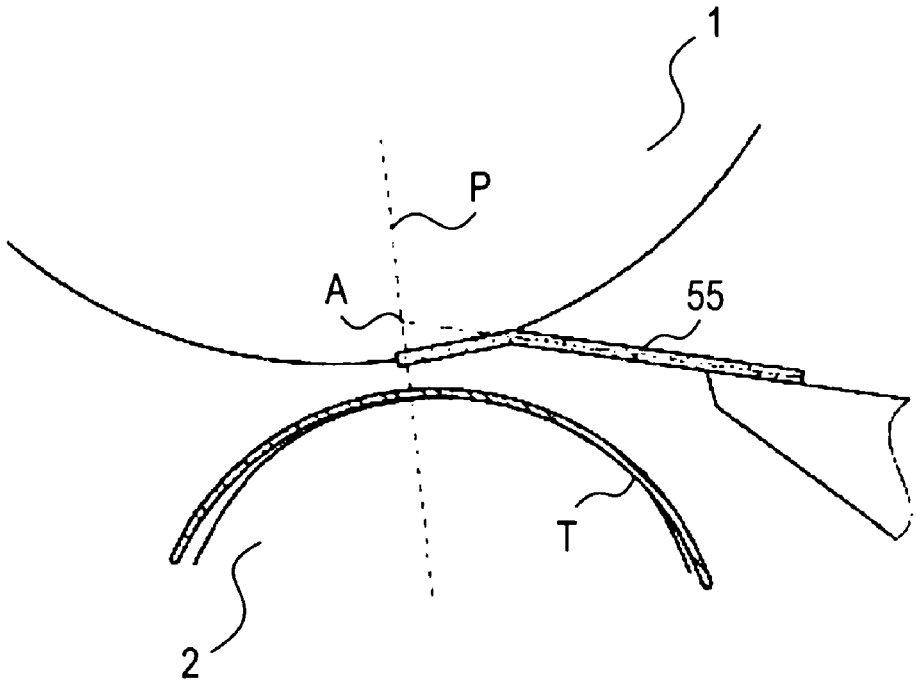

FIG. 12 shows a schematic structural view of a developing apparatus in this embodiment.

With respect to structures and operations, members or means identical to those used in Embodiment 1 are represented by identical reference numerals or signs and explanation therefor is omitted.

As features of Embodiment 2, a jumping developer control member 52 is disposed toward point A, on the line P connecting the rotation centers of the photosensitive drum 1 and the developing roller 2, located within the photosensitive drum 1. By doing so, the jumping developer control member 53 is pressed against the photosensitive drum 1 surface. In this embodiment, as the jumping developer control member 52, an elastic sheet member comprising a 500 μm-thick PET (polyethylene terephthalate) film is used.

Effects of this embodiment will be described.

The jumping developer control member 52 is required to be accurately inserted into the SD gap of 300 μm. In this embodiment, the jumping developer control member 52 is pressed against the photosensitive drum 1 by using the elastic sheet member, whereby it becomes possible to accurately set the free end position of the jumping developer control member 53 to a desired position.

Further, by the contact between the photosensitive drum 1 and the jumping developer control member 53, the toner is prevented from being deposited on the surface of the jumping developer control member 53 facing the photosensitive drum 1. As a result, the downstream concentration image is not caused to occur even when a developing operation is repetitively performed.

Further, by using the insulating member as the jumping developer control member 53, even in a low atmospheric pressure environment, a voltage causing the image defect due to discharge phenomenon was substantially equal to that in the case where the jumping developer control member is not used.

Embodiment 4

Figure 13:
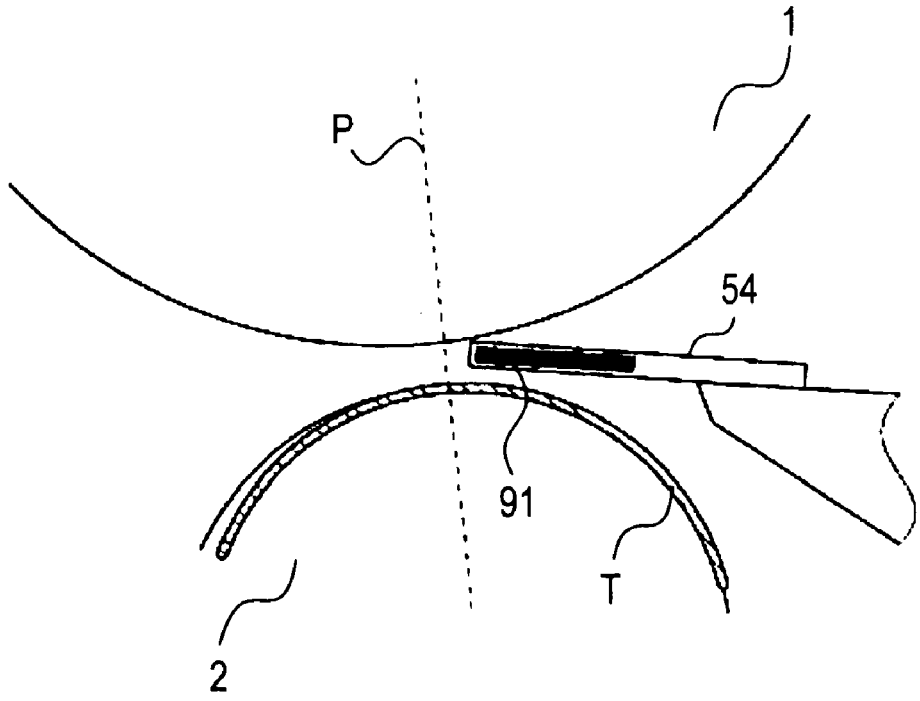

FIG. 13 shows a schematic structural view of a developing apparatus in this embodiment.

With respect to structures and operations, members or means identical to those used in Embodiment 1 are represented by identical reference numerals or signs and explanation therefor is omitted.

As features of Embodiment 4, a plate-like jumping developer control member 54 comprising an electrode 91 a an electroconductive member and an insulating member surrounding and covering the electrode 91 is disposed by inserting it into the developing zone, with the proviso that the electrode is disposed in such an electrically floating manner that it is not electrically connected.

In this embodiment, it is possible to attain the same effects as in Embodiment 1.

Hereinbelow, the case where a developing apparatus having the same structure as that of Embodiment 4 except that the electrode is supplied with a voltage, will be described as Comparative Embodiment 3.

Comparative Embodiment 3

In this comparative embodiment, a DC bias voltage is applied to the electrode 91 in the developing apparatus of Embodiment 4, and is otherwise identical to Embodiment 4.

When the DC bias voltage is applied to the electrode member 91, an oscillation electric field is created between the electrode 91 and the developing roller 2, whereby the jumping developer control member 54 per se makes electric bending vibration with a fixed and thereof being fixed. By this vibration, the free end of the jumping developer control member 54 is caused to contact the photosensitive drum and the developing roller. In such a state that the free end of the jumping developer control member 54 contacts or is close to the toner on the developing roller, by an electric field created between the developing roller and the opposing surface of the jumping developer control member 54 located opposite to the photosensitive drum, the toner on the developing roller is actively deposited on the opposing surface of the jumping developer control member 54. Then, the deposited toner forms the downstream concentration image by the action of an electric field created between the jumping developer control member 54 and the photosensitive drum 1.

Here, the vibration of the jumping developer control member will be described.

In the case of using the developing apparatus employing the monocomponent developer, different from the developing apparatus employing the two component developer, a chain of carrier or the like is not created in the developing zone. For this reason, it is preferable that the SD gap is set to be narrower, desirably in a range of 200-400 μm, in order to ensure a sufficient density in the monocomponent developing scheme in the case of effecting development in a noncontact manner. Further, for the reasons described above, in the case where the jumping developer control member is inserted with no contact thereof with the toner layer on the developing roller, an appropriate thickness of the jumping developer control member is from 10 μm to 300 μm in correspondence with the SD gap. In the case when such a jumping developer control member is used and inserted into the oscillation electric field in the SD gap, as described above, the jumping developer control member per se is caused to vibrate.

As in Embodiment 4, in the case where the electrode portion is in an electrically floating state even when the jumping developer control member includes an insulating member or an electrode, there is no electric field between the jumping developer control member and the developing roller even if the jumping developer control member is vibrated by the oscillation electric field. For this reason, the toner is little moved and deposited on an upper surface portion of the jumping developer control member. Accordingly, it is possible to prevent the downstream concentration image even in repetitive developing operation.

In the above described embodiments, each jumping developer control member is supported so that a supporting portion for supporting it is located at an upper position and the free end thereof is located at a lower position, in a gravity direction. In other words, the jumping developer control member is disposed so as to droop in the direction of gravity, and such a disposition is preferred. By doing so, flow of air into the gap between the developing roller and the photosensitive drum is restricted and thus air stream is reduced. Accordingly, it is possible to reduce an amount of developer carried from the upstream side to the downstream side by the air stream in the rotation direction of the developing roller and the photosensitive drum, thereby to suppress scattering of developer.

Next, another embodiment of the developing apparatus according to the present invention will be described.

Figure 16:
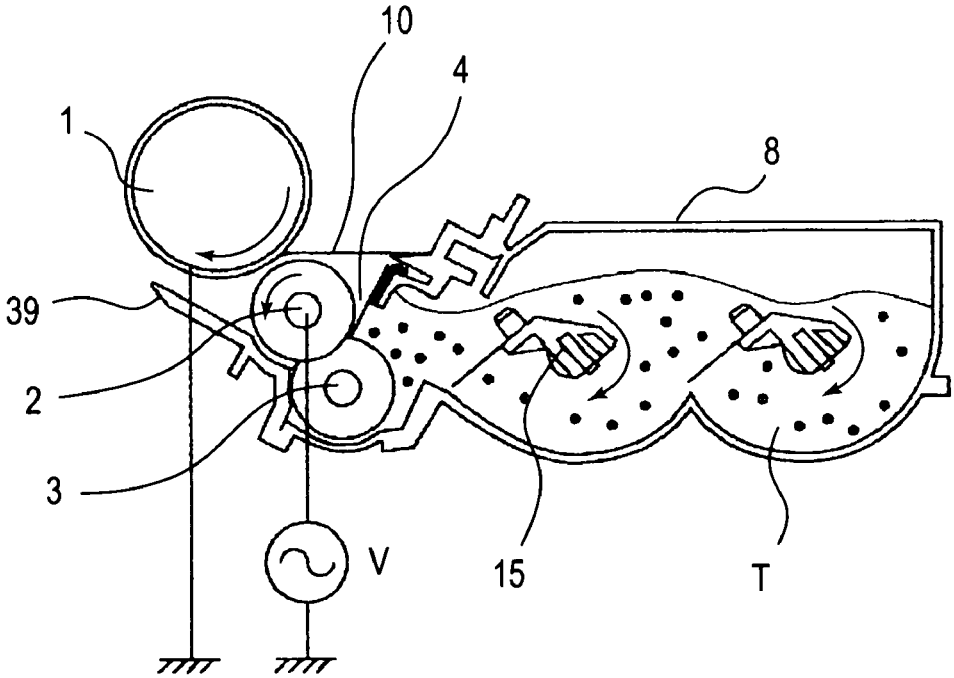
FIG. 16 is a sectional view for illustrating a developing apparatus according to an embodiment of the present invention.

FIG. 16 is a sectional view showing the developing apparatus of the present invention and an image forming apparatus.

The image forming apparatus includes a photosensitive drum 1, as an image bearing member, which comprises a metallic cylinder coated with a photoconductive material. On the photosensitive drum 1, an electrostatic latent image is formed by an unshown latent image forming means. To the photosensitive drum 1, a developing apparatus is disposed oppositely. The developing apparatus includes a developer container 8 containing toner T as developer. In this embodiment, the toner T is a negatively chargeable nonmagnetic monocomponent toner and contains a pigment or dye comprising a colorant of yellow, magenta, cyan, black, etc.

In the toner container 8, a toner stirring member 15 comprising, e.g., a plate-like member shaped in various forms, or a screen, is rotated in a direction of an indicated arrow in FIG. 16, whereby the toner T in the developer container 8 is fed toward a developing roller 2 as a developer carrying member. Thus, the toner stirring member creates a toner supply passage. The number of stirring member is not limited so long as the stirring member can create the toner supply passage for supplying the toner from an end portion of the developer container to the developing roller. A scraping/supply roller 3 is disposed opposite to the developing roller 2 in a contact or noncontact manner. The scraping/supply roller 3 is rotationally driven to provide a difference in rotation speed between it and the developing roller 2, so that it has a function of supplying an appropriate amount of toner to the developing roller 2 and scraping the toner, on the developing roller 2, which has not been subjected to development even after being passed through an opposing position between the developing roller 2 and the photosensitive drum 1. The rotation direction of the scraping/supply roller 3 is not particularly restricted but may preferably be identical to that of the developing roller 2 (e.g., in a counterclockwise direction in FIG. 16) from the viewpoint of performances of toner supply and scraping.

Against the developing roller 2, a regulation blade 4 as a toner amount regulation member is abutted, whereby it regulates the toner on the developing roller 2 to form a thin toner layer. The regulation blade 4 has a function of determining an amount of toner carried in a developing zone (a position opposite to the photosensitive drum 1) and electrically charging the toner by friction between the toner and the regulation blade. The regulation blade 4 comprises, e.g., a thin metal plate (about several hundred μm thick) of phosphor bronze, stainless steel, etc. In order to triboelectrically charge the toner uniformly, a thin film of polyamide elastomer or the like may be laminated on an abutting surface of the regulation blade abutted against the developing roller 2. The thin metal plate may have a top of urethane resin or silicone resin, formed by adhesion or integral shaping, at a free end portion thereof. By elasticity of the thin metal plate, the regulation blade 4 is uniformly abutted against the developing roller 2.

An amount of toner and a charge amount of toner conveyed in the developing zone in the vicinity of the opposing portion between the photosensitive drum 1 and the developing roller 2 are determined by an abutting pressure, an abutting length, etc., of the regulation blade 4 contacting the developing roller 2. The abutting pressure is determined by a material, a thickness, and an amount of bending, of the thin metal plate, and an abutting angle between the regulation blade 4 and the developing roller 2. The amount per surface unit area of toner conveyed on the developing roller 2 is controlled in a range of about 0.3-1.0 mg/cm$^2$ by appropriately setting respective factors.

A developing jaw 39 disposed downstream from the developing roller 2 in the rotation direction of the photosensitive drum 1 is a protective member for covering the developing roller 2 and also has a function of collecting toner scattered from a developing portion at the time of image formation.

The photosensitive drum 1 is rotationally driven by an unshown drive means in a rotation direction indicated therein by an arrow in FIG. 16. The photosensitive drum 1 and the developing roller 2 are kept in a noncontact state with a certain gap (SD gap) therebetween. The toner on the developing roller 2 is caused to jump over the SD gap to be deposited on the electrostatic latent image on the photosensitive drum 1. In order to cause the toner to jump, to the developing roller 2, a superposition voltage comprising a DC voltage and an AC voltage is applied, thus creating an alternating electric field between the developing roller 2 and the photosensitive drum 1.

Between the developing roller 2 and the photosensitive drum 1, a jumping control plate 10, as a plate-like jumping developer regulation member, for controlling the toner by regulating a jumping zone of developer, is disposed. A material for the jumping control plate 10 may preferably be electrically high resistance, further preferably be excellent in insulating property. Such a material may have a volume resistivity of not less than $10^4$ ohm.cm, preferably not less than $10^9$ ohm.cm. The jumping control plate 10 may preferably have flexibility and can be formed, in a 10-500 μm thick sheet, of a polymeric material, such as polyurethane, polystyrene, polyethylene, polypropyrene, PVC (polyvinyl chloride), acrylic resin, or styrene-vinyl acetate copolymer.

Particularly, the jumping control plate 10 may preferably has a softness and an elasticity to such an extent that a free end thereof is readily bent by pressing it with one finger in a sheet state and the free end position is easily returned to its original position when the pressure is released. In order to obtain the flexibility, the jumping control plate may more preferably have a thickness of not less than 40 μm. Further, in order to obtain the softness described above, the jumping control plate may more preferably have a thickness of not more than 300 μm. As the jumping control plate, in addition to the above described materials, it is suitably use plastic materials, selected from various engineering plastics, capable of being shaped in a sheet form. However, in order to keep the above described flexibility, a filler such as glass fiber or the like used as a reinforcing agent in the resin or plastic may preferably be used in a minimum necessary amount or omitted. As the jumping control plate 10, an electrically insulating sheet or an electrically floating sheet may preferably be used. In other words, it is preferable that an electric field is not created between the jumping control plate 10 and the photosensitive drum 1 and between the jumping control plate 10 and the developing roller 2.

The jumping control plate 10 has a fixed end, as one end, fixed to the developing container 8 and a free end as the other end. The jumping control plate 10 is disposed so that it is bent from the fixed end is abutted against the photosensitive drum 1 at its free end side. The jumping control plate 10 is disposed in a bent shape so as to have a convey surface similar to the surface (shape) of the developing roller 2. Further, the jumping control plate 10 is kept at a certain distance from the developing roller 2 without being apart from the developing roller 2.

The free end of the jumping control plate 10 is disposed substantially within the developing zone in which the toner is caused to jump by the alternating electric field, whereby it physically hinders the jumping of toner on the upstream side of the developing zone in the movement direction of the photosensitive drum 1, thus limiting the toner jumping zone.

By using the jumping control plate 10 described above, it is possible to reduce of toner (presence of a larger amount of toner) at a trailing end of image.

The jumping control plate 10 is used to prevent the downstream concentration of toner by suppressing the amount of toner subjected to development on the upstream side from the closest portion (between the photosensitive drum 1 and the developing roller 2). In order to prevent the downstream concentration of toner, it is preferable that the jumping control plate 10 is abutted against the photosensitive drum 1 so as to reduce the amount of toner moved and deposited on the jumping control plate surface opposite to the photosensitive drum surface.

Figure 17:
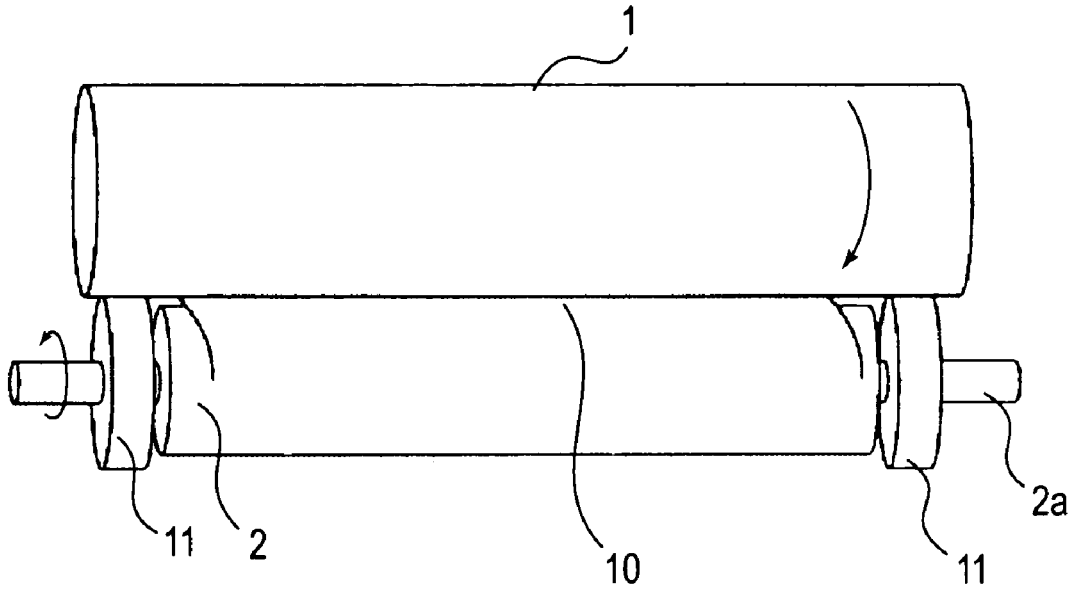
FIG. 17 is a perspective view for illustrating a developing apparatus according to an embodiment of the present invention.

FIG. 17 is a perspective view of the jumping control plate 10. The photosensitive drum 1 is rotated in a direction of an arrow, and the developing roller 2 is disposed opposite to the photosensitive drum 1. A core metal 2*a* is extended coaxially with a central (axis) portion of the developing roller 2 and is rotationally driven in a direction of an arrow. The core metal 2 is pressed against the photosensitive drum 1, by an unshown pressing means, through gap retaining rollers 11 as a gap retaining means for retaining a gap between the photosensitive drum 1 and the developing roller 2, or receives a pressing force from the photosensitive drum 1 side. Each end (close to the developing roller 2) of the core metal 2*a* is rotatably engaged with the gap retaining roller 11 formed of an organic polymer material, such as slidable polyacetal resin, which is excellent in slidability and has a relatively small compressive strain. The gap retaining roller 11 has an outer diameter larger than the developing roller 2 and is pressed against the photosensitive drum 1 at a pressing force to keep the developing roller 2 and the photosensitive drum 1 at a constant distance therebetween. Into such a gap where the photosensitive drum 1 and the developing roller 2 are opposed to each other, the jumping control plate 10 is inserted from the upstream side in the photosensitive drum rotation direction. In order to achieve the effect of the jumping control plate 10 in the entire developing zone, a length of the free end of the jumping control plate 10 in the axial direction of the photosensitive drum 1 may preferably be longer than a width of the photosensitive drum 1 where the electrostatic latent image is formed.

Incidentally, as described above, it effectively prevents the downstream concentration of toner when the free end of the jumping control plate abuts against the photosensitive drum compared with the case where it is apart from the photosensitive drum. JP-A Hei 8-95373 describes a method wherein a plate-like control electrode member is abutted against a photosensitive drum in a straight line manner. However, in the method, as described later, a closest distance between a developing roller and the control electrode member is considerably smaller than an SD (sleeve-drum) gap (between the developing roller and the photosensitive drum) in some cases. Particularly, in a high temperature-high humidity environment, a surface resistance of the control electrode member can be lowered depending on an ambient humidity and a hygroscopic property of the control electrode member. Am amplitude of a voltage of an oscillation electric field created between the photosensitive drum and the developing roller is ordinarily set to be smaller than a discharge limit potential difference known by Paschen's law so as not to cause electric discharge (current leakage) in the SD gap and also set to a potential difference capable of causing the developer to sufficiently jump in the SD gap.

However, the closest distance between the developing roller and the control electrode member is considerably smaller than the SD gap, so that current leakage is caused to occur in the SD gap, thus resulting in an occurrence of such an electric discharge (creeping discharge) that a current is passed through the photosensitive drum along the surface of the control electrode member, in some cases. For this reason, the current leakage is liable to occur in the case where the jumping control plate contacts the developing roller or the photosensitive drum. Further, when the jumping control plate does not contact the photosensitive drum, the control by the jumping control plate is less effective. As a result, the above described developer downstream concentration prevention effect is decreased.

The jumping control plate is bent to be abutted against the photosensitive drum, whereby it is possible to increase the closest distance between the jumping control plate and the developing roller. As a result, the above described leakage can be prevented. Based on these findings, the present invention has been accomplished.

Hereinbelow, specific structures of the free end of the jumping control plate and its vicinity in the above described image forming apparatus will be described based on embodiments.

Embodiment 5

Figure 18:
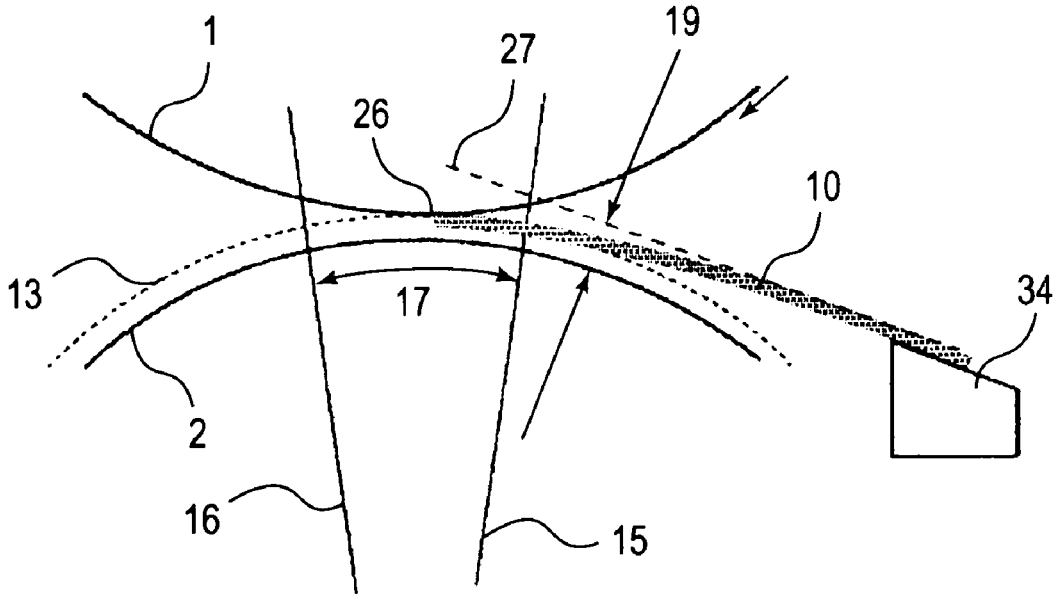
FIGS. 18, 19, 21 and 22 are respectively a sectional view for illustrating a developing apparatus according to an embodiment of the present invention.

FIG. 18 is an enlarged sectional view of the free end of the jumping control plate and its vicinity for illustrating a developing apparatus according to this embodiment in the above described image forming apparatus.

Referring to FIG. 18, a photosensitive drum 1 comprises an aluminum tube coated with a photosensitive substance. A developing roller 5 comprises a metallic roller having an outer diameter of 16 mm (at a surface close to the photosensitive drum 1) and including a core metal portion, which has a diameter of 10 mm, at its both end portions. The surface of the metallic roller is coated with a phenolic resin containing carbon black particles as roughening particles. The coating film may be, other than the phenolic resin coating film, a surface-coated layer used as a surface layer of developing roller for an ordinary contact development. For example, the surface-coated layer may be prepared by dispersing various roughening particles for adjusting a surface roughness, various charge control agents, and so on, in a binder resin or rubber, such as silicone resin (rubber), NBR (nitrile-butadiene rubber), hydrin-based resin (rubber), nylon resin, urethane resin (rubber), fluorine-containing resin, etc. The photosensitive drum 1 and the developing roller 2 are kept in a noncontact state with a gap of 300 μm by a gap (SD gap) retaining roller 13 indicated by a dotted line. When the gap between the photosensitive drum 1 and the developing roller 2 is made narrower to the extent that a jumping control plate 10 is sandwiched between the photosensitive drum 1 and the developing roller 2, streak image is undesirably caused to occur.

The SD gap may preferably be not less than 10 μm so as not to cause the jumping control plate to be sandwiched between the photosensitive drum and the developing roller, in view of a change in SD gap. In consideration of a sheet thickness of not less than 40 μm providing an appropriate stiffness, the SD gap may more preferably be not less than 50 μm. Further, if the SD gap is excessively broadened, the toner is less liable to be caused to jump. As a result, a developing performance is lowered, and an ordinal function of the developing apparatus is not performed. Accordingly, the SD gap may preferably be not more than 1 mm. Particularly, in a nonmagnetic monocomponent developing scheme, a magnetic chain of developer cannot be formed, so that the thickness of a developer layer becomes thinner and a jumping distance becomes longer. Accordingly, the SD gap may more preferably be not more than 50 μm.

The effect of the jumping control plate 10 is irrespective of the rotation direction of the developing roller 2 if the jumping control plate 10 is inserted from the upstream side in the rotation direction of the photosensitive drum 1. In this embodiment, the photosensitive drum 1 is rotated in a direction of an arrow indicated in FIG. 18, and the developing roller 2 is rotated so that it is moved in the same direction as the photosensitive drum 1 in the vicinity of an opposing portion therebetween.

The jumping control plate 10 is inserted into the gap in the opposing portion between the photosensitive drum 1 and the developing roller 2, so that the free end of the jumping control plate 10 abuts against the photosensitive drum 1 at a position 26 in FIG. 18. The other end of the jumping control plate 10 is fixed on a base 34 which is integrally disposed with the developer container.

A dashed line 27 represents a position of the jumping control plate 10 when the photosensitive drum 1 is removed, and is a substantially straight line. In this state, the jumping control plate 10 is disposed so that its free end enters the photosensitive drum (with the assumption that it is present) and does not contact the developing roller. A closest distance, indicated by arrows 19, between the dashed line 27 and the photosensitive drum 1 is set to 900 μm, which is larger than the SD gap (300 μm).

When the photosensitive drum 1 is mounted, the jumping control plate 10 is bent from the fixed end side on the base 34 and is disposed so that it is abutted against the photosensitive drum at an edge of its free end. Determination as to whether the free end of the jumping control plate is abutted against the photosensitive drum at its edge is made through such an observation that a glass or plastic-made drum, which has an identical shape to the photosensitive drum 1 and a high light transmittance, is mounted, and the abutting (contact) state of the free end of the jumping control plate is a line contact state or a surface contact state. As necessary, a small amount of liquid, such as water, is applied to the abutting portion. When a spacing filled with the liquid by its surface tension is present at both sides of the contact point, the abutting state is determined as a surface abutting state. When the spacing is present only one side of the contact point, the abutting state is determined as an edge abutting state. In order to ensure the edge abutment for the contact between the photosensitive drum and the free end of the jumping control plate, for example, the free end position is adjusted by changing a free length of the jumping control plate.

An abutment position 25 of the free end of the jumping control plate 10 is in the substantial developing zone 17. The developing zone 17 can, e.g., be determined as follows.

First, the developing apparatus 1 is operated for about 1 minutes and the operation is stopped in a state that charged toner is carried on the developing roller. The jumping control plate is removed and in a state that rotation of the photosensitive drum and the developing roller is stopped, application of bias voltage is terminated after an alternating electric field applied during an ordinary development is applied for abut 10 sec. When the alternating electric field is terminated in order to measure the developing zone with good reproducibility, it is preferable that an electric field in a direction of movement of toner toward the photosensitive drum is finally terminated. As a result, the toner on the developing roller in the developing zone is forced out and thus a zone in which almost no toner is deposited on the developing roller is created. This zone, i.e., a toner-less zone 17 between an upstream end 15 and a downstream end 16.

Thereafter, the jumping control plate and the transparent drum are mounted, and the sheet position is set so that the free end position of the jumping control plate is located in the developing zone when viewed from the photosensitive drum side by observing a relative positional relationship between the jumping control plate free end position and the toner lacking zone with eyes. The developing zone is ordinarily about 1-4 mm which is clearly broader than the SD gap or the thickness of the jumping control plate, so that it is possible to set the free end position within the developing zone without being largely affected by eye observation angle, refractive index of the transparent drum, etc. In this embodiment, the free end position of the jumping control plate is disposed at an almost central position of the developing zone.

In this embodiment, the above described jumping control plate is mounted to the developing apparatus shown in FIG. 16. The jumping control plate is formed of a 50 μm-thick PET (polyethylene terephthalate) film having a free length (from the supporting point of the base to the free end) of 8.1 mm, and its free end is disposed within the developing zone having a width (length) of about 4 mm. The photosensitive drum has an outer diameter of 30 mm and is electrically charged to have a surface potential of −500 V. The electrostatic latent image portion has a potential of −80 V to −500 V. The developing roller has a diameter of 16 mm. A gap, between the developing roller and the photosensitive drum, of 300 μm is kept by the SD gap retaining roller.

To the developing roller, a rectangular wave (average voltage (DC component): −260 V, frequency: 3 kHz, amplitude 1.8 kVpp (peak-to-peak voltage), duty: 50%) was applied. An amount of toner carried on the developing roller was 0.4 mg/cm$^2$, and a charge amount was 20-30 μC/mg. The above carrying amount and the charge amount are calculated as follows. In a state that there is no photosensitive drum, the developing apparatus is operated for about 30 seconds and stopped, and then toner on the developing roller in the vicinity of the developing zone is sucked to measure a weight of toner coating layer on the developing roller, a charge amount of the toner coating layer, and a suctioned area. The carrying amount is determined by dividing the weight by the area, and the charge amount is determined by dividing the charge amount by the weight.

Further, four color toners of cyan, magenta, yellow, and black were charged in four developing apparatuses, respectively, according to this embodiment, and the developing apparatuses were mounted in an image forming apparatus. When the image forming apparatus was subjected to image formation (printing) on 5000 sheets in an environment (temperature: 35° C., humidity: 80% RH, atmospheric pressure: 1000 kPa) in such a manner that the printing was first performed on 2500 sheets and, after being intermitted for 20 hours, then further performed on 2500 sheets. A problem as to an image was not particularly caused to occur. Further, in the above environment, at the time when the amplitude of the AC voltage applied to the developing roller was increased to 2.8 kVpp, the current leakage was generated to cause spot-like image failure.

Embodiment 6

Figure 19:
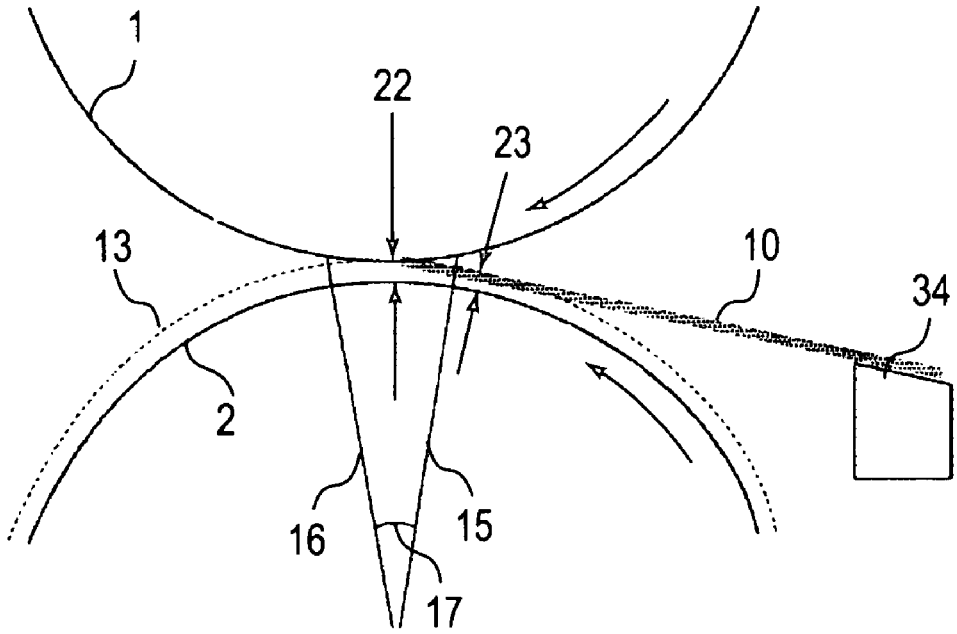

FIG. 19 is an enlarged sectional view of a free end of a jumping control plate 10 and its vicinity for illustrating a developing apparatus of this embodiment in the above described image forming apparatus. The jumping control plate 10 is formed in a thickness of 150 μm by compression-molding a nylon 6 resin containing 30 wt. % of glass fiber, and is disposed so that a free end position thereof is located in a region 17 defined by an upstream end 15 and a downstream end 16 in a developing zone. In this embodiment, the free end position of the jumping control plate 10 is located at an almost central portion of the developing zone. The jumping control plate 10 contacts the photosensitive drum 1 at its edge portion. Confirmation of the contact (abutting) state is effected in the same manner as in Embodiment 1.

An SD gap retaining roller 13 keeps a gap, between a photosensitive drum 1 and a developing roller 2, indicated by arrows 22, at 300 μm. A closest distance between a surface of the jumping control plate 10 and the developing roller 2 is 50 μm.

The photosensitive drum 1 is rotated in a direction of an arrow, and the jumping control plate 10 is inserted substantially linearly and upwardly (on the drawing) into the developing zone from the upstream side in the photosensitive drum rotation direction. The jumping control plate 10 is fixed on a base 34 at its (fixed) end.

Similarly as in Embodiment 5, the photosensitive drum 1 has an outer diameter of 30 mm and is electrically charged to have a surface potential of −500 V. Further, an electrostatic latent image portion has a potential of −80 V to −500 V. To the developing roller 2, a rectangular wave (average voltage (DC component): −260 V, frequency: 3 kHz, amplitude: 1.8 kVpp (peak-to-peak voltage), duty: 50%) was applied. An amount of toner carried on the developing roller 2 was 0.4 mg/cm$^2$, and a charge amount was 20-30 μC/mg. These (carrying and charge) amounts were measured in the same manner as in Embodiment 5.

Further, four color toners of cyan, magenta, yellow and black were charged in four developing apparatuses, respectively, according to this embodiment, and the developing apparatuses were mounted in an image forming apparatus. When the image forming apparatus was subjected to image formation (printing) on 5000 sheets in an environment (temperature: 35° C., humidity: 80% RH, atmospheric pressure: 1000 kPa) in such a manner that the printing was first performed on 2500 sheets, and, after being intermitted for 20 hours, then further performed on 2500 sheets, current leakage was caused to occur at the time of printing on 100 sheets immediately after the intermittence. At that time, spot-like image failure and many streak images were caused to occur. Further, in the above environment, at the time when the amplitude of the AC voltage applied to the developing roller 2 was increased to 2 kVpp, the leakage was steadily generated to cause spot-like image failure.

Comparative Embodiment 4

Figure 20:
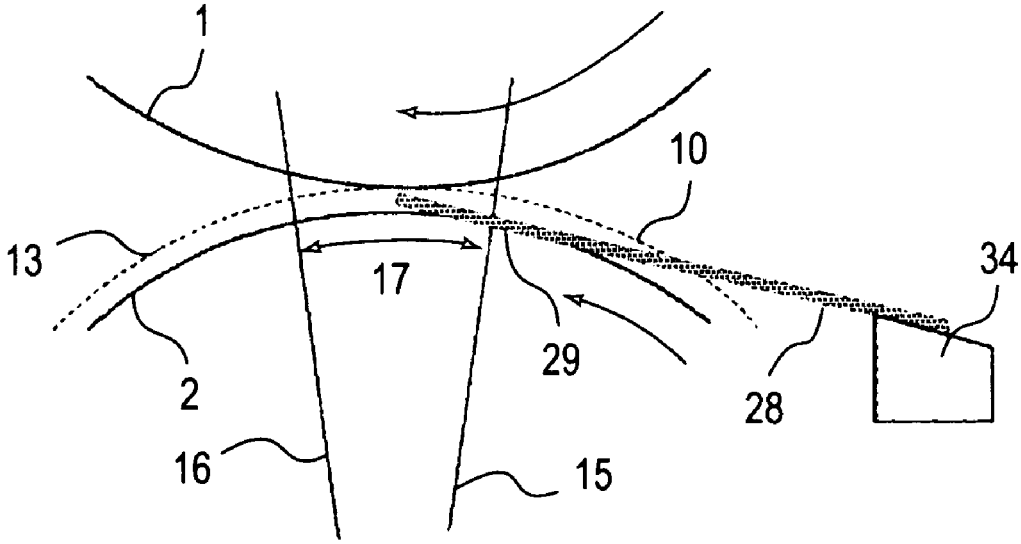
FIG. 20 is a sectional view for illustrating a developing apparatus according to a comparative embodiment.

FIG. 20 is an enlarged sectional view of a free end of a jumping control plate 10 and its vicinity for illustrating a developing apparatus of this comparative embodiment in the above described image forming apparatus. The structure of the developing apparatus of thus comparative embodiment is one wherein the structure disclosed in JP-A Hei 8-30089 and JP-A Hei 8-22185 is adapted to a noncontact monocomponent developing apparatus, an electrode is omitted, and a free end position of a plate-like jumping control plate. The jumping control plate 10 comprises a 200 μm-thick glass epoxy substrate, and is disposed so that a free end position thereof is located in a region 17 defined by an upstream end 15 and a downstream end 16 in a developing zone. The jumping control plate 10 is disposed so that it does not contact the photosensitive drum 1 but contacts the developing roller 2 at a position 29 in a surface abutment manner.

A distance between the free end of the jumping control plate 10 and the photosensitive drum 1 is set to 50 μm.

The photosensitive drum 1 is rotated in a direction of an arrow, and the jumping control plate 10 is inserted substantially linearly and upwardly (on the drawing) into the developing zone from the upstream side in the photosensitive drum rotation direction. The jumping control plate 10 is fixed on a base 34 at its (fixed) end.

Similarly as in Embodiment 5, the photosensitive drum 1 has an outer diameter of 30 mm and is electrically charged to have a surface potential of −500 V. Further, an electrostatic latent image portion has a potential of −80 V to −500 V. To the developing roller 2, a rectangular wave (average voltage (DC component): −260 V, frequency: 3 kHz, amplitude: 1.8 kVpp (peak-to-peak voltage), duty: 50%) was applied. An amount of toner carried on the developing roller 2 was 0.4 mg/cm$^2$, and a charge amount was 20-30 μC/mg. These (carrying and charge) amounts were measured in the same manner as in Embodiment 5.

Further, four color toners of cyan, magenta, yellow and black were charged in four developing apparatuses, respectively, according to this embodiment, and the developing apparatuses were mounted in an image forming apparatus. When the image forming apparatus was subjected to image formation (printing) on 5000 sheets in an environment (temperature: 35° C., humidity: 80% RH, atmospheric pressure: 1000 kPa) in such a manner that the printing was first performed on 2500 sheets, and, after being intermitted for 20 hours, then further performed on 2500 sheets, current leakage was caused to occur at the time of printing on 100 sheets immediately after the intermittence. At that time, spot-like image failure and many streak images was caused to occur. Further, at the trailing end of the solid image, the downstream concentration of toner was caused to occur. Further, in the above environment, at the time when the amplitude of the AC voltage applied to the developing roller 2 was increased to 1.9 kVpp, the leakage was steadily generated to cause spot-like image failure.

Embodiment 7

Figure 21:
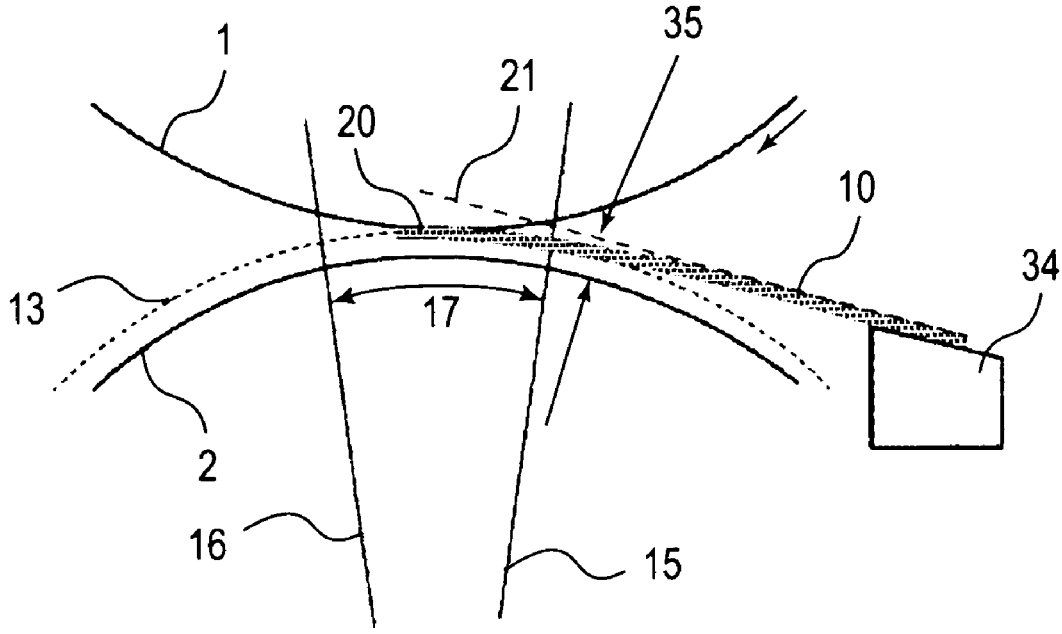

FIG. 21 is an enlarged sectional view of a free end of a jumping control plate 10 and its vicinity for illustrating a developing apparatus of this embodiment in the above described image forming apparatus. The jumping control plate 10 comprises a 50 μm-thick PET sheet, and is disposed so that a free end position thereof is located in a developing zone 17.

A dashed line 21 represents a position of the jumping control plate 10 when the photosensitive drum 1 is removed, and is a substantially straight line. In this state, the jumping control plate 10 is disposed so that its free end enters the photosensitive drum (with the assumption that it is present) and does not contact the developing roller. A closest distance, indicated by arrows 35, between the dashed line 21 and the photosensitive drum 1 is set to 1.2 mm, which is larger than the SD gap (300 μm).

When the photosensitive drum 1 is mounted, the jumping control plate 10 is bent from the fixed end side on the base 34 and is disposed so that it is abutted against the photosensitive drum at a surface thereof. When the photosensitive drum is mounted, a closet portion between the jumping control plate and the developing roller is disposed in the developing zone and in the vicinity of the abutment portion of the jumping control plate against the photosensitive drum.

Determination of the surface abutment is effected in the same manner as in Embodiment 5. An angle and entering depth of the jumping control plate are adjusted so that a small amount of liquid is applied to the abutment portion and a space filled with the liquid due to a surface tension of the liquid is created at both sides of the abutment portion.

Similarly as in Embodiment 5, the photosensitive drum 1 has an outer diameter of 30 mm and is electrically charged to have a surface potential of −500 V. Further, an electrostatic latent image portion has a potential of −80 V to −500 V. To the developing roller 2, a rectangular wave (average voltage (DC component): −260 V, frequency: 3 kHz, amplitude: 1.8 kVpp (peak-to-peak voltage), duty: 50%) was applied. An amount of toner carried on the developing roller 2 was 0.4 mg/cm$^2$, and a charge amount was 20-30 μC/mg. These (carrying and charge) amounts were measured in the same manner as in Embodiment 5.

Further, four color toners of cyan, magenta, yellow and black were charged in four developing apparatuses, respectively, according to this embodiment, and the developing apparatuses were mounted in an image forming apparatus. When the image forming apparatus was subjected to image formation (printing) on 5000 sheets in an environment (temperature: 35° C., humidity: 80% RH, atmospheric pressure: 1000 kPa) in such a manner that the printing was first performed on 2500 sheets, and, after being intermitted for 20 hours, then further performed on 2500 sheets, a problem as to an image was not caused to occur. Further, in the above environment, at the time when the amplitude of the AC voltage applied to the developing roller 2 was increased to 2.9 kVpp, the leakage was steadily generated to cause spot-like image failure.

Embodiment 8

Figure 22:
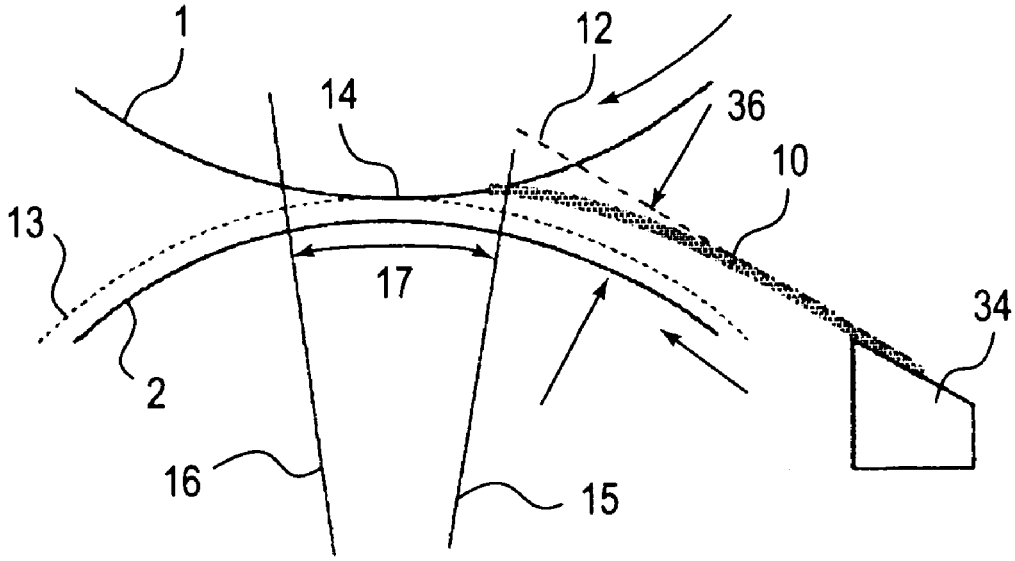

FIG. 22 is an enlarged sectional view of a free end of a jumping control plate 10 and its vicinity for illustrating a developing apparatus of this embodiment in the above described image forming apparatus. The jumping control plate 10 comprises a 100 μm-thick PET sheet, and is disposed so that a free end position thereof is located in a developing zone 17.

A dashed line 12 represents a position of the jumping control plate 10 when the photosensitive drum 1 is removed, and is substantially straight line. In this state, the jumping control plate 10 is disposed so that its free end enters the photosensitive drum (with the assumption that it is present) and does not contact the developing roller. A closest distance, indicated by arrows 36, between the dashed line 12 and the photosensitive drum 1 is set to 3 mm, which is larger than the SD gap (300 μm).

When the photosensitive drum 1 is mounted, the jumping control plate 10 is bent from the fixed end side on the base 34 and is disposed so that it is abutted against the photosensitive drum at a surface thereof. At that time, the jumping control plate is disposed so that it does not intersect a line 13 defined by an outer periphery of an SD gap retaining roller. When the photosensitive drum is mounted, a closet portion between the jumping control plate and the developing roller is disposed in the developing zone and between the jumping control plate and the developing roller. A closest distance therebetween is about 350 μm.

Determination of the surface abutment is effected in the same manner as in Embodiment 5. An angle and entering depth of the jumping control plate are adjusted so that a small amount of liquid is applied to the abutment portion and a space filled with the liquid due to a surface tension of the liquid is created at both sides of the abutment portion.

Similarly as in Embodiment 5, the photosensitive drum 1 has an outer diameter of 30 mm and is electrically charged to have a surface potential of −500 V. Further, an electrostatic latent image portion has a potential of −80 V to −500 V. To the developing roller 2, a rectangular wave (average voltage (DC component): −260 V, frequency: 3 kHz, amplitude: 1.8 kVpp (peak-to-peak voltage), duty: 50%) was applied. An amount of toner carried on the developing roller 2 was 0.4 mg/cm$^2$, and a charge amount was 20-30 μC/mg. These (carrying and charge) amounts were measured in the same manner as in Embodiment 5.

Further, four color toners of cyan, magenta, yellow and black were charged in four developing apparatuses, respectively, according to this embodiment, and the developing apparatuses were mounted in an image forming apparatus. When the image forming apparatus was subjected to image formation (printing) on 5000 sheets in an environment (temperature: 35° C., humidity: 80% RH, atmospheric pressure: 1000 kPa) in such a manner that the printing was first performed on 2500 sheets, and, after being intermitted for 20 hours, then further performed on 2500 sheets, a problem as to an image was not caused to occur. Further, in the above environment, at the time when the amplitude of the AC voltage applied to the developing roller 2 was increased to 3.0 kVpp, the leakage was steadily generated to cause spot-like image failure.

Comparative Embodiment 5

A developing apparatus according to this comparative embodiment has the same structure as the developing apparatus of Embodiment 5 except that the jumping control plate and the base therefor were removed.

Similarly as in Embodiment 5, the photosensitive drum 1 has an outer diameter of 30 mm and is electrically charged to have a surface potential of −500 V. Further, an electrostatic latent image portion has a potential of −80 V to −500 V. To the developing roller 2, a rectangular wave (average voltage (DC component): −260 V, frequency: 3 kHz, amplitude: 1.8 kVpp (peak-to-peak voltage), duty: 50%) was applied. An amount of toner carried on the developing roller 2 was 0.4 mg/cm$^2$, and a charge amount was 20-30 μC/mg. These (carrying and charge) amounts were measured in the same manner as in Embodiment 5.

Further, four color toners of cyan, magenta, yellow and black were charged in four developing apparatuses, respectively, according to this embodiment, and the developing apparatuses were mounted in an image forming apparatus. When the image forming apparatus was subjected to image formation (printing) on 5000 sheets in an environment (temperature: 35° C., humidity: 80% RH, atmospheric pressure: 1000 kPa) in such a manner that the printing was first performed on 2500 sheets, and, after being intermitted for 20 hours, then further performed on 2500 sheets, spot-like image failure was not caused to occur but the downstream concentration of toner was occur at a trailing end of solid image. Further, in the above environment, at the time when the amplitude of the AC voltage applied to the developing roller 2 was increased to 3.0 kVpp, the current leakage was steadily generated to cause spot-like image failure.

Figure 23:
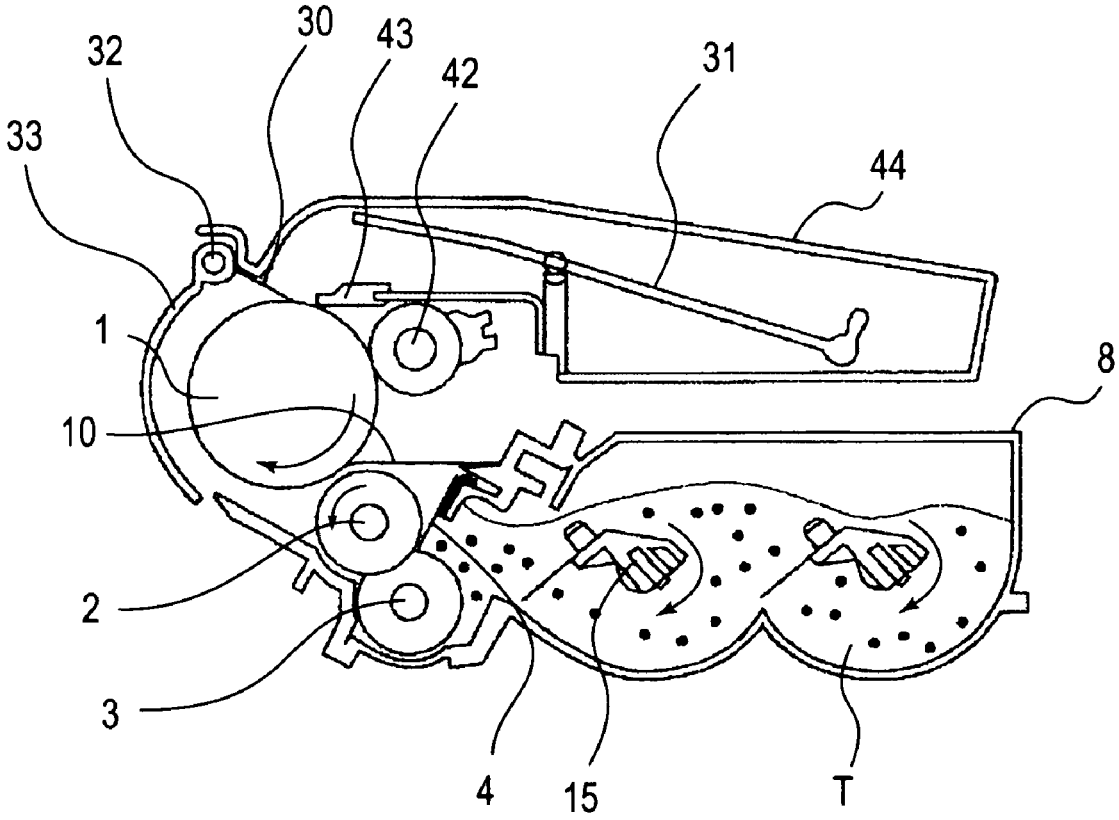
FIG. 23 is a sectional view for illustrating a process cartridge used in the present invention.

FIG. 23 is a sectional view for illustrating a process cartridge including the developing apparatus according to any of the above described Embodiments 5-8.

Referring to FIG. 23, a charge roller 42 is abutted against a photosensitive drum 1 and rotated by rotation of the photosensitive drum 1. The charge roller 42 has a function of electrically charging the photosensitive drum 1 uniformly at the time of image formation.

A cleaning blade 43 abuts against the photosensitive drum and has a function of scraping an excessive developer on the photosensitive drum at the time of image formation. The scraped waste toner is contained in a waste toner container by a feeding means 31. A scooping sheet 30 slightly contacts the photosensitive drum to seal the waste toner container 44 so as not to cause leakage of the waste toner from the waste toner container 44. A shutter 33 is openable on the basis of a hinge 32 as a supporting portion and has a function of protecting the photosensitive drum by being closed at the time when the process cartridge is removed from the image forming apparatus.

Other members are similar to those in Embodiments 5-8, thus being omitted for detailed explanation. As described above, the image forming portion including the jumping control plate is integrally supported to provide the process cartridge, whereby it becomes easy to replenish the developer and replace the waste toner with new one, and maintenance by a user can be advantageously simplified. Further, even in the case where contamination of the jumping control plate is generated by a long-term use of the developing apparatus, hands of the user are not contaminated and the process cartridge can be integrally replaced together with other components needing periodic replacement, thus being excellent in maintenance performance.

The results of Embodiments 5-8 described above are summarized in Table 1.

TABLE 1

| Emb. | *1 | *2 | *3 | Distance *4 | |
|---|---|---|---|---|---|
| No. | Image | Leakage (V) | DC | 1 (μm) | 2 (μm) |
| 5 | No | 2800 | ○ | 900 | about 250 |
| 6 | Yes | 2000 | ○ | 50 | about 50 |
| 7 | No | 2900 | ○ | 1200 | about 250 |
| 8 | No | 3000 | ○ | 3000 | 300 |
| Comp. 4 | Yes | 1900 | x | 50 | about 50 |
| Comp. 5 | No | 3000 | x | — | 300 |

(Notes)
*1: "Image" represents a spot-like image failure. "Yes" represents an occurrence of such an image failure, and "No" represents no occurrence of such an image failure, through image formation on 5000 sheets.
*2: "Leakage" represents a steady-state current leakage generation voltage, i.e., an amplitude voltage which generates steadily a spot-like image failure when an AC voltage amplitude is increased in the high temperature/high humidity environment. A larger voltage value provides a longer time period causing current leakage, thus being preferable.
*3: "DC* represents a downstream concentration of toner "○" represents no or a slight occurrence of downstream concentration of toner to an acceptable of unacceptable downstream concentration of toner.
*4: "Distance 1" represents a closest distance between the jumping control plate and the developing roller when there is no photosensitive drum. "Distance 2" represents an electrical closest distance, i.e., an insulation distance, between the developing roller and the photosensitive drum under the assumption that the entire surfaces of the jumping control plate are an electrically good conductor in a state that thephotosensitive drum is mounted. In all the Embodiments 5-8, a flexible jumping control plate is used and bent to be abutted against the photosensitive drum in a convex direction in correspondence with the surface shape of the developing roller (i.e., where both of centers of localized circles of curvature are located on the same side in two regions divided by one of curves), and the developing roller and the abutment position ofthe jumping control plate are located in a substantial developing zone. By doing so, a distance between the jumping control plate and the developer carrying member (developing roller) can be made longer than in the conventional developing apparatus. As a result, it is possible to attain a current leakage-preventing effect.

In the present invention, the bending direction of the jumping control plate is set to the convex direction in correspondence with the developing roller surface, whereby it becomes possible to ensure a spatial distance between the jumping control plate and the developing roller along the periphery of the developing roller.

When the jumping control plate contacts the developing roller, current leakage along the surface of the jumping control plate is liable to occur and in addition thereto, a streak-like image failure is undesirably caused to occur as a result of an irregularity in toner coating on the developing roller. In the noncontact development, the SD gap (of 50 μm to about 1 mm) in narrower as compared with the developing roller diameter (of about 3-100 mm), so that the jumping control plate is readily abutted against the developing roller when an inserting (entering) angle thereof is excessively large. For this reason, the free end of the jumping control plate may preferably be inserted at an inserting angle of not less than 60 degrees and not more than 120 degrees with respect to a line connecting closest points of the jumping control plate and the photosensitive drum. It is more preferable that the insertion direction of the jumping control plate is substantially perpendicular to the line connecting the closest points. By setting the abutment position of the jumping control plate with the photosensitive drum in the substantial developing zone, the entering (inserting) angle of the jumping control plate is made smaller to prevent the free end of the jumping control plate from being close to the developing roller.

In Embodiment 5, the flexible member is used as the jumping control plate and the closest distance between the plate-like member (jumping control plate) and the developer carrying member (developing roller) when there is no image bearing member (photosensitive drum) is larger than the closest distance between the image bearing member and the developer carrying member. By using such a structure, it is possible to prevent a decrease in closest distance 2 when compared with the cases of Embodiment 6 and Comparative Embodiment 4. Outside the developing zone, it becomes possible to increase an electrical distance between the plate-like member and the developer carrying member. As a result, it is possible to prevent current leakage generated along the surface of the plate-like member (jumping control plate) due to a lowering in surface resistance of jumping control plate in a high temperature/high humidity environment.

This is because the jumping control plate is used in a linear state in Embodiment 6 and Comparative Embodiment 4, so that the closest distance 2 between the jumping control plate and the developing roller becomes smaller (than the SD gap and the thickness of jumping control plate), irrespective of a thickness of the jumping control plate used. On the other hand, in Embodiment 5, the closest position is moved to effectively increase the closest distance 2 as compared with those in Embodiment 6 and Comparative Embodiment 4. It is more preferable that a rough radius of curvature of the jumping control plate in its bent state is larger than a radius of curvature of the developing roller, in order to prevent current leakage.

In Embodiment 7, the plate-like member is bent to abut against the image bearing member at its surface. By such a surface abutment of the jumping control plate against the photosensitive drum, the leakage current is required to reach the photosensitive drum through such a passage that it is moved around the free end of the jumping control plate, so that a distance along the surface of the jumping control plate is increased. For this reason, when a surface resistance of the jumping control plate is equal to that of the photosensitive drum, it is possible to increase a voltage causing the current leakage. As a result, the leakage preventing effect is further enhanced.

In Embodiment 8, the abutment portion between the plate-like member and the image bearing member is located upstream from the closest portion between the image bearing member and the developer carrying member in the rotation direction of the image bearing member, and the closest distance between the plate-like member and the developer carrying member is larger than the closest distance between the image bearing member and the developer carrying member. By providing such a structure that the jumping control plate and the line defined by the outer periphery of the SD gap retaining roller do not intersect with each other by disposing the abutment portion between the jumping control plate and the photosensitive drum on the upstream side of the developing zone, compared with Comparative Embodiment 5, the effect of preventing downstream concentration of toner is retained and at the same time, no leakage from the developing roller to the photosensitive drum is caused to occur. As a result, it is possible to achieve anti-leakage performance equal to that in the case of no jumping control plate.

In the above described embodiments, the free end position of the jumping control plate is disposed at almost central portion of the developing zone. However, when the free end position is located on the downstream side from the developing zone, the developing zone is covered with the jumping control plate, so that an amount of toner which is subjected to development is undesirably decreased. On the other hand, when the free end position is located on the upstream side from the developing zone, the effect of preventing the downstream concentration of toner is undesirably decreased.

The free end position is not limited to the central portion of the developing zone since it is possible to realize the effect of preventing the downstream concentration of developer and the developing performance in combination when the free end position is located within the developing zone. THe free length of the jumping control plate is not particularly limited but may preferably be not less than 1 mm in order to obtain a sufficient flexibility and not more than 50 mm in order to provide a good positional accuracy. Further, the distance between the free end of the jumping control plate and the photosensitive drum surface when there is no photosensitive drum, i.e., the entering amount of the jumping control plate (into the photosensitive drum), may preferably be not less than 10 μm, more preferably not less than 100 μm, in order that the jumping control plate can contact the photosensitive drum at its substantial surface even when the free end of the jumping control plate has undulation. Further, the entering amount may preferably be smaller than a radius of curvature of the photosensitive drum in the developing zone (15 mm in the above described embodiments) so as not to generate eversion of the free end of the jumping control plate. The entering amount may more preferably not more than 5 mm in order to prevent streak image. The base for supporting the jumping control plate may preferable be fixed on the developing apparatus side from the viewpoint of positional accuracy but may be disposed on the photosensitive drum side or a main assembly side of the image forming apparatus.

In the above described embodiments, the developing apparatuses using the nonmagnetic monocomponent developer is used. However, the present invention is effective also with respect to a developing apparatus using a magnetic monocomponent developer. Further, the present invention is effective with respect to a developing apparatus using a two component developer comprising toner and a carrier but its effect is limitative because the SD gap is generally larger than that in the case of the developing apparatus using the monocomponent developer, thus being less liable to cause the above described leakage. However, in the case where the carrier has a volume resistivity of not more than $10^8$ ohm.cm to have a larger electrode effect, the leakage is liable to become problematic. Accordingly, the present invention may suitably be used in such a case.

In the developing apparatus using the two component developer, it is difficult to determine the developing zone on the developing roller in the above described manner due to the presence of carrier, in some cases. In such cases, printing of the entire solid black image is performed in such a state that an AC amplitude is 0 V in the developing apparatus from which the jumping control plate is removed. When the rotation of the photosensitive drum and the developing roller is stopped during image formation and immediately thereafter an ordinary developing bias voltage is applied for several seconds, followed by termination of application thereof, toner is transferred onto the photosensitive drum. After the photosensitive drum is removed, the jumping control plate is mounted and then the photosensitive drum on which the toner is deposited is gently mounted in the original position. In this state, in the case where the toner on the photosensitive drum contacts the jumping control plate to be deposited on the jumping control plate, the jumping control plate is located in the developing zone.

The present invention is also effective with respect to a developing apparatus in which an electrode is disposed in the vicinity of the free end of jumping control plate to ground the toner in the developing zone. However, in such a structure that the electrode is provided to the jumping control plate and is supplied with a voltage, a strong electrostatic force acts on a spacing between the electrode and the developing roller, whereby developing noise is largely increased together with vibration of the jumping control plate. As a result, jitter is liable to occur at the abutment portion of the jumping control plate against the photosensitive drum or the developing roller. When the jitter is caused to occur, the developer (toner) is moved on a surface, opposing the photosensitive drum, of the jumping control plate, so that the preventing effect of downstream concentration of toner at the trailing end of the solid image is undesirably decreased. For this reason, in the present invention, it is more preferable that the jumping control plate is not provided with an electrode or is provided with an electrode which is not supplied with a voltage, i.e., is placed in an electrically floating state. When the jumping control plate is a rigid member, an abutting pressure between the photosensitive drum and the jumping control plate largely varies depending on a minute fluctuation in SD gap. As a result, the photosensitive drum is triboelectrically charged or the abutment portion of the jumping control plate is triboelectrically charged, so that the latent image or the developed image is disturbed to cause image failure. Also from this viewpoint, the jumping control plate may preferably be a flexible sheet.

Embodiment 9

In all the above described embodiments, the width (length) of jumping developer regulation member in its longitudinal direction is set to be larger than that of an image forming area of the photosensitive drum in the longitudinal direction of the jumping developer regulation member. Such a width relationship is shown in FIG. 24.

Figure 24:
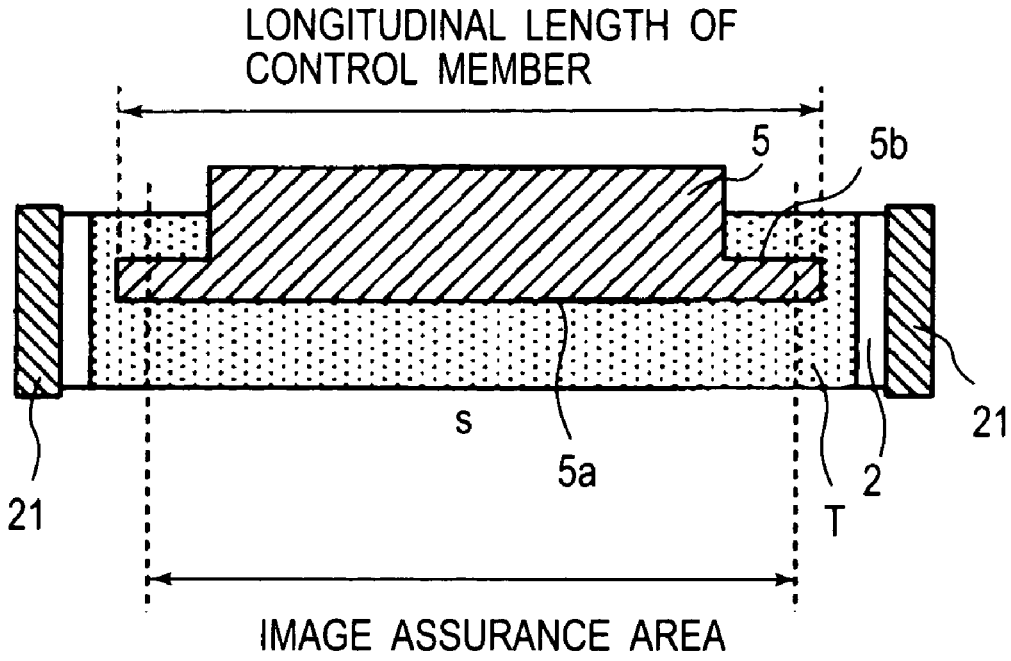
FIGS. 24, 25, 27 and 28 are respectively a front view showing structural members in a developing zone and its vicinity in an embodiment of the present invention.

FIG. 24 is an arrangement view of a control member 5 as the jumping developer regulation member when viewed from the photosensitive drum 1 side in the developing apparatus. At both ends of the developing roller 2 in its axial direction, SD gap retaining rollers 21 are disposed to retain the SD gap. A presence area (width) of the control member in the developing roller 2 axial direction, i.e., a longitudinal length of the control member is set so that it is larger than the image forming area as an image assurance area in which an image on the photosensitive drum is formed, in a direction parallel to the axial direction of the developing roller 2. The control member 5 has a free end 5*a* and is supported at a portion 5*b*.

As described above, by disposing the control member 5 so that the free end 5*a* of jumping developer regulation member (control member) is present, in the developing zone, over an area broader than the image assurance area of the developing roller 2, in a direction intersecting a circumferential direction of the developing roller 2, i.e., in the axial direction of the developing roller 2, the downstream concentrated portion of toner is regulated by the control member 5. As a result, the toner is not deposited on the surface of photosensitive drum 1, so that it becomes possible to form a good image for a long period of time. This effect is further ensured by disposing the control member 5 on the upstream side in the rotational direction of the developing roller 2.

Embodiment 10

In this embodiment, only the width (length) of the jumping developer control member (control member) 5 in the axial direction of the developing roller 2 is changed in a developing apparatus having the same structure and set conditions as the developing apparatus according to Embodiment 9.

Figure 25:
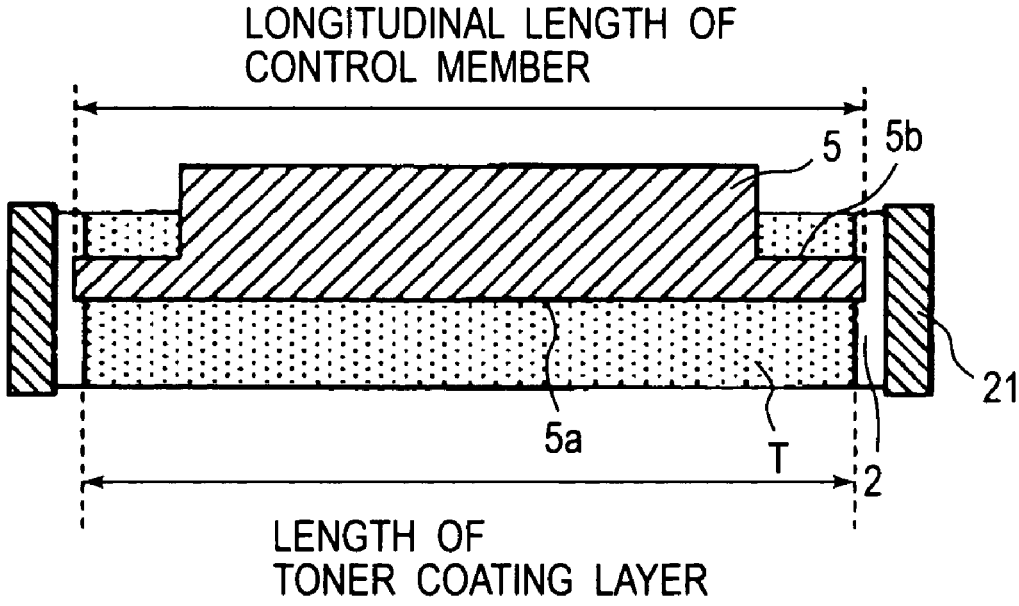

FIG. 25 is an arrangement view of the control member 5 when viewed from the photosensitive drum 1 side in this embodiment. The structure and operation of the developing roller 2 are similar to those in Embodiment 9, thus being omitted from explanation.

In this embodiment, the length of the control member 5 in the axial direction of developing roller 2 is set so that it is longer than a width of toner coating layer in a surface axial direction of developing roller 2.

Under some image forming conditions, developing can be performed in an area broader than the image assurance area. Further, the toner coating layer is disposed in an area which is broader than the developing zone in some cases. In these cases, an occurrence of downstream concentration of toner can more effectively prevented with reliability by disposing the control member 5 so that it is broader than the toner coating layer on the developing roller 2.

Embodiment 11

In this embodiment, only the arrangement of the jumping developer control member (control member) 5 is changed in a developing apparatus having the same structure and set conditions as the developing apparatus according to Embodiment 9.

Figure 26:
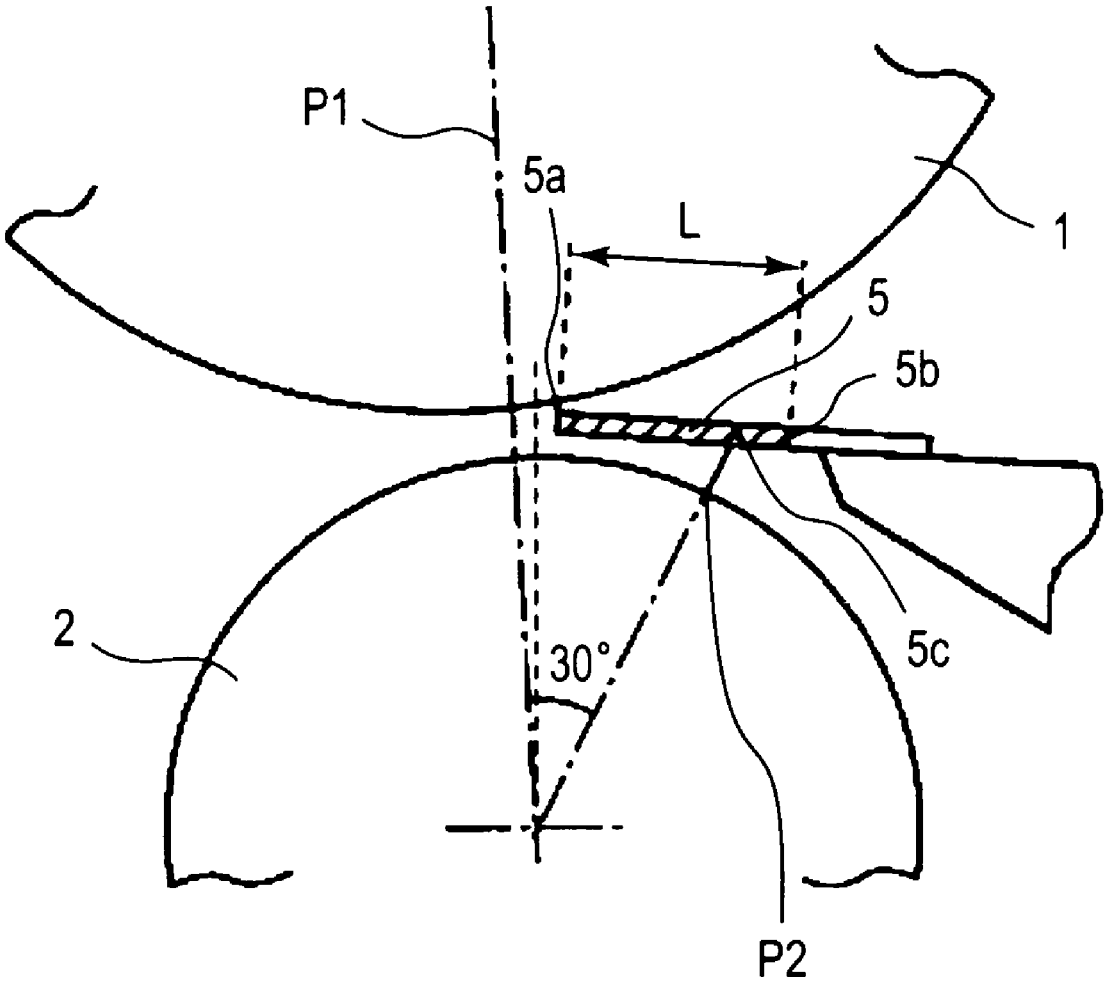
FIG. 26 is a side view showing structural members in a developing zone and its vicinity in an embodiment of the present invention.
Figure 27:
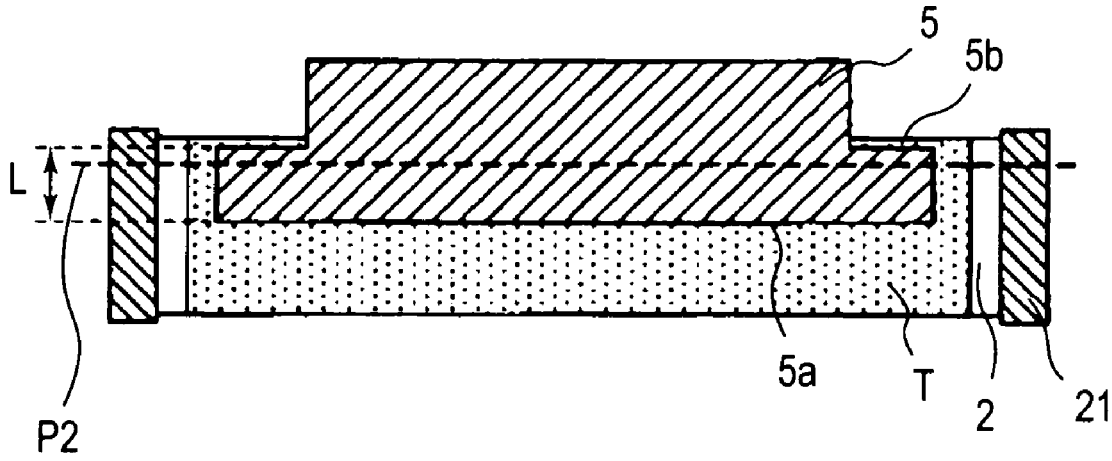

FIG. 26 is an enlarged view of a developing zone and its vicinity when viewed from the side of the developing roller 2 and the photosensitive drum 1 in this embodiment with respect to their rotation direction. Further, FIG. 27 is an arrangement view of the control member 5 when viewed from the photosensitive drum 1 side in this embodiment. The structure and operation of the developing roller 2 are similar to those in Embodiment 9, thus being omitted from explanation.

In this embodiment, a length L of the control member 5 from a free end (edge) 5*a* toward an upstream direction in the rotation direction of the developing roller 2 is determined as an edge-to-edge length L in the following manner.

In the control member 5 as the plate-like member, a position of an edge 5*b* defining a substantial regulation (control) portion of the control member 5 together with the free end 5*a* is taken as the other edge of the plate-like control member 5. For example, in this embodiment, the plate-like control member 5 is fixed on another member (the developer container in this embodiment) at its fixed end. A portion between the fixed end and the edge 5*b* has a shorter longitudinal length than the substantial regulation portion of the control member 5. This narrower portion is a mounting portion on the developer container, i.e., a portion where the control member 5 is supported on the developer container. Without consideration of this narrower (mounting) portion of the control member 5, the edge of the control member 5 located at a boundary between the substantial regulation portion and the mounting portion is taken as the edge 5*b* (FIG. 27) in this embodiment. A distance between the edge 5*b* and the edge (free end) 5*a*, i.e., a length from the edge 5*a* to the edge 5*b* in a direction perpendicularly intersecting the edge 5*a*, is defined herein as an edge-to-edge length L.

When the control member 5 is regarded as the plate-like member which is caused to enter the developing zone from the upstream side in the rotation direction of the developing roller 2, the entering edge is the edge 5*a* and thus the edge 5*b* can also be regarded as an entering start proton. The direction of the edge-to-edge length L is along the control member 5, thus being the entering direction toward the developing zone.

The edge-to-edge length L, as shown in

FIGS. 26 and 27, may preferably be such a length as to cover the surface toner coating layer on the developing roller 2 from a portion, on the surface of the developing roller 2, opposite to the free end (edge) 5*a* of the control member 5 to an area providing an angle of not less than 30 degrees, in a direction opposite from the developing roller rotation direction, from a reference center line segment P1 (connecting the rotation centers of the developing roller 2 and the photosensitive drum (image bearing member) 1. In other words, the control member 5 is disposed so as to cover the developer (toner) carried on the developing roller 2 from a position providing an angle of less than 30 degrees to a position providing an angle of more than 30 degrees, in the opposition direction to the developing roller rotation direction, on the basis of a position of 0 degrees connecting the rotation centers of the developing roller 2 and the photosensitive drum 1.

More specifically, when the center line segment P1 from the center of developing roller 2 is taken as 0 degrees; a line segment, in a radial extension direction, providing 30 degrees from the center line segment P1 in the direction opposite from the rotation direction of developing roller 2 is taken as P2; and a position where the line segment P2 and the control member 5 intersect with each other is taken as 5*c*; the edge-to-edge length L from the free end 5*a* to the edge (entering start portion) 5*b* in the direction along the control member 5 may preferably set to be longer than a distance from the free end 5*a* to the position 5*c*.

By setting the edge-to-edge length L as described above, it becomes possible to prevent movement of the downstream concentrated toner to the photosensitive drum 1 for a long period of time.

When the edge-to-edge length L is shorter than the distance from the free end 5*a* to the position 5*c*, the toner T is caused to jump not only on the upstream side in the rotation direction of the developing roller 2 but also outside the developing zone at both end portions of the developing roller 2. Further, when the developing apparatus is operated for a long time, there arises such a phenomenon that the jumping toner accumulates on the surface of the control member 5 facing the photosensitive drum 1 at longitudinal ends of the control member 5. As a result, problems, such as a downstream concentrated image or image irregularity at an image end portion in the longitudinal direction of the control member 5, falling of massive toner from the end portion of the control member 5 to the end portion of the developing roller 2, and scattering of toner, are caused to occur in some cases.

Accordingly, as in this embodiment (Embodiment 11) shown in FIGS. 26 and 27, the edge-to-edge length L form the free end 5*a* to the edge 5*b* may preferably be longer than the length from the free end 5*a* to the position 5*c*.

As the edge-to-edge length L becomes longer, it becomes more difficult to ensure a free end positional accuracy. Accordingly, the edge-to-edge length L may preferably be not more than 50 mm.

Embodiment 12

In this embodiment, only the arrangement of the jumping developer control member (control member) 5 is changed in a developing apparatus having the same structure and set conditions as the developing apparatus according to Embodiment 9.

Figure 28:
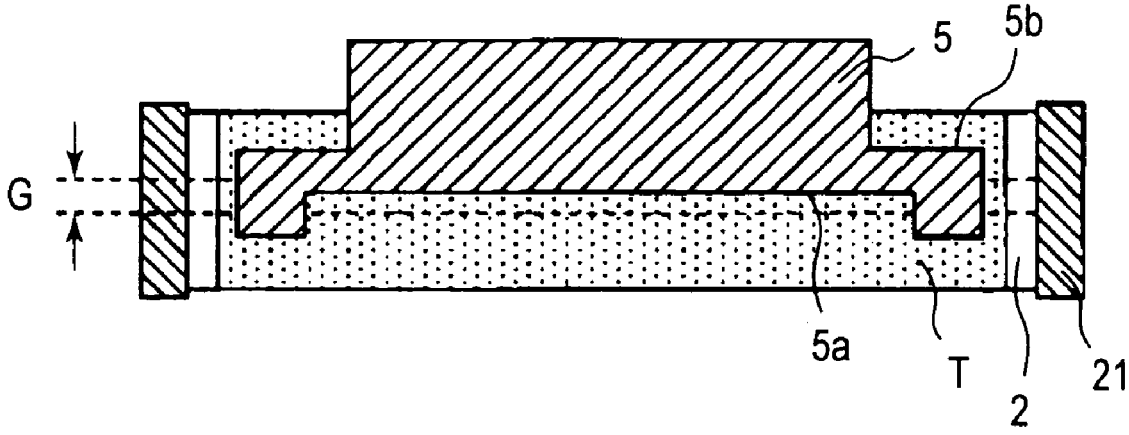

FIG. 28 is an arrangement view of the control member 5 when viewed from the photosensitive drum 1 side in this embodiment. The structure and operation of the developing roller 2 are similar to those in Embodiment 9, thus being omitted from explanation.

In this embodiment, as shown in FIG. 28, the control member 5 is disposed so that only both end portions of the control member 5 in a direction parallel to the developing roller 2 axial direction cover a region G in a circumferential direction of the developing roller 2 in the developing zone. A central portion of the control member 5 in the axial direction of the photosensitive drum 1 and the developing roller 2 covers the developing zone from its center position.

Herein, the both end portions of the control member 5 in the developing roller 2 axial direction refer to portions located at least on the end side than (outside) the image assurance area on the developing roller 2.

The scattering toner is generally scattered in a direction of airstream generated by rotation of the photosensitive drum 1 and the developing roller 2. However, at the end portions, the airstream is disturbed by the SD gap retaining rollers or the like. For this reason, the toner in the vicinity of the end portions is scattered in various directions. Further, the toner scattered from the vicinity of the end portions is not recovered again onto the developing roller 2 or the photosensitive drum 1, thus being liable to be scattered outside of the developing apparatus 100.

Accordingly, as in this embodiment, by disposing the jumping developer control member 5 so that its end portions in its longitudinal direction cover the developing zone which is a zone causing the scattering toner, it becomes possible to reduce the toner scattered from the end portions of the developing roller 2. As a result, the above described difficulty can be alleviated.

Embodiment 13

In this embodiment, only the arrangement of the jumping developer control member (control member) 5 is changed in a developing apparatus having the same structure and set conditions as the developing apparatus according to Embodiment 9.

Figure 29:
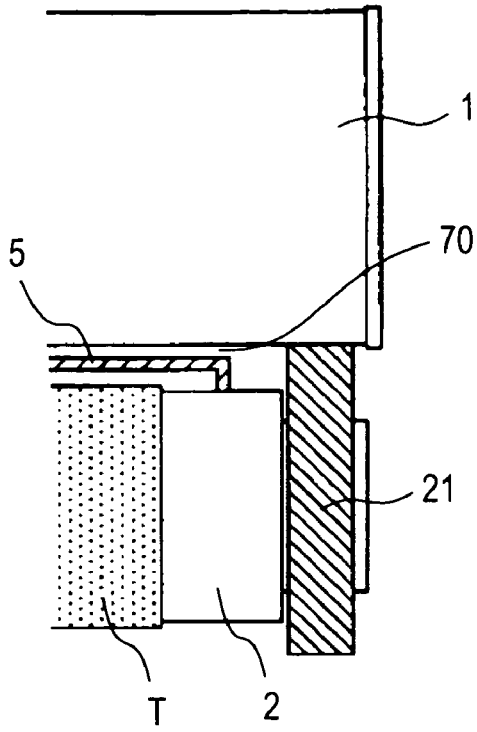
FIGS. 29 and 30 are respectively a partial front view showing an end portion structure of a developer carrying member in an embodiment of the present invention.

FIG. 29 is an enlarged view of an end portion of the developing zone in this embodiment. The structure and operation of the developing roller 2 are similar to those in Embodiment 9, thus being omitted from explanation.

In this embodiment, as shown in FIG. 29, an end portion of the control member 5 in the axial direction of the photosensitive drum 1 and the developing roller 2 is bent toward the developing roller 2 side.

By disposing the control member 5 as described above, a space directed from the end portion of the developing roller 2 toward the outside of the developing apparatus is blocked. As a result, the scattering toner directed toward the outside the developing apparatus is prevented from escaping to the outside of the developing apparatus. By doing so, the above described image failure can be minimized. Particularly, it becomes possible to prevent contamination of the developing apparatus with the scattering toner.

Embodiment 14

In this embodiment, only the arrangement of the jumping developer control member (control member) 5 is changed in a developing apparatus having the same structure and set conditions as the developing apparatus according to Embodiment 9.

Figure 30:
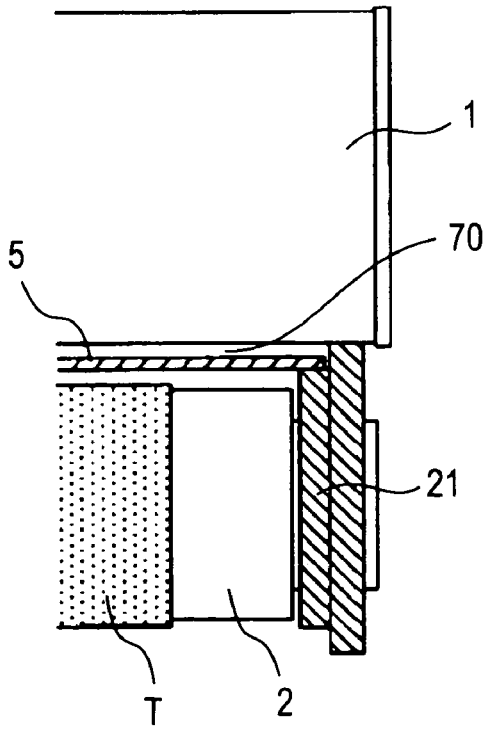

FIG. 30 is an enlarged view of an end portion of the developing zone in this embodiment. The structure and operation of the developing roller 2 are similar to those in Embodiment 9, thus being omitted from explanation.

In this embodiment, as shown in FIG. 13, an end portion of the control member 5 is disposed in contact with or close to an SD gap retaining roller 21 disposed at both end portions of the developing roller 2.

By doing so, mounting of the jumping developer control member 5 is stabilized, so that it is possible to prevent downstream concentration of toner for a long period of time to realize good image formation.

Further, the scattering toner is prevented from escaping to the outside of the developing apparatus, whereby the above described deficiencies are remedied. Particularly, contamination of the developing apparatus with the scattering toner can effectively be prevented.

Embodiment 15

In this embodiment, only the arrangement of the jumping developer control member (control member) 5 is changed in a developing apparatus having the same structure and set conditions as the developing apparatus according to Embodiment 9.

FIG. 25 is an arrangement view of the jumping developer control member 5 when viewed from the photosensitive drum 1 side in this embodiment. The structure and operation of the developing roller 2 are similar to those in Embodiment 9, thus being omitted from explanation.

Figure 31:
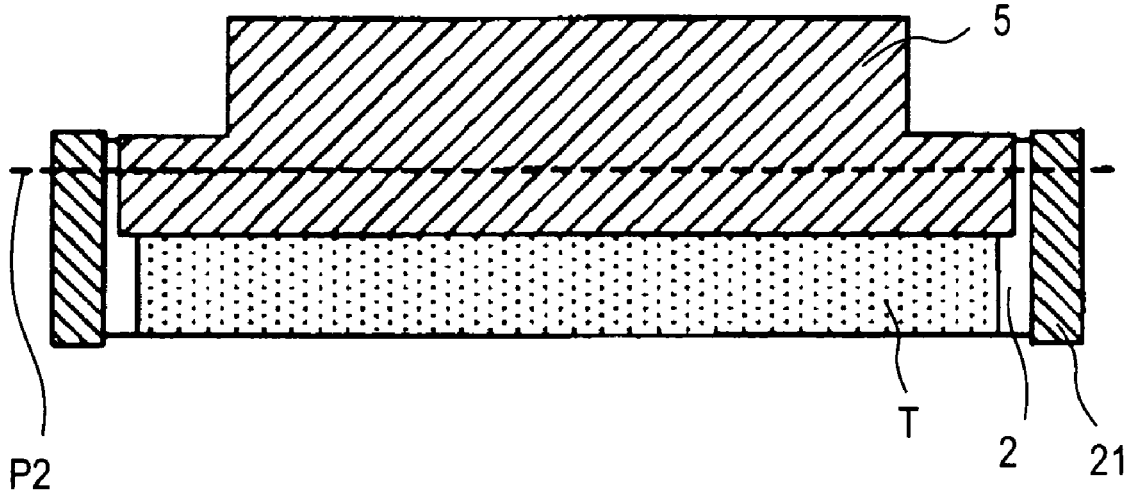
FIG. 31 is a front view showing structural members in a developing zone and its vicinity in an embodiment of the present invention.

In this embodiment, as shown in FIG. 31, the jumping developer control member 5 is disposed so that a width (length) thereof in the axial direction of the photosensitive drum 1 and the developing roller 2 is broader than a length of the surface toner coating layer T of the developing roller 2 and it covers the toner coating layer T from the free end position thereof to a position P2 providing an angle, from the line segment P1, of not less than 30 degrees on the upstream side in the rotation direction of developing roller 2. In other words, the developing apparatus of this embodiment has a combination of the structures of those in Embodiments 10 and 11.

Even in the case where, under some image forming conditions, development is performed in an area broader than the image assurance area or the toner coating layer is formed in an area broader than the developing zone, it is possible to prevent an occurrence of downstream concentration of toner with reliability by disposing the jumping developer control member 5 so as to have a width broader than that of the toner coating layer on the developing roller 2.

The downstream concentrated toner image is caused to occur not only when the toner is a black toner but also when the toner is a color toner, so that the jumping developer control members 5 used in the above described embodiments can be employed in not only a monochromatic image forming apparatus but also a color image forming apparatus. However, particularly when the color toner is used, the downstream concentrated toner image becomes conspicuous. Accordingly, the jumping developer control members in the above described embodiments may preferably be used in the color image forming apparatus, and may also be applicable to a developing apparatus for effecting development with a two component developer.

Dimensions, materials, shapes and relative positional relationships of the structural members or means used in the above described image forming apparatuses are not particularly limited, unless otherwise specifically identified.

As described hereinabove, according to the present invention, it is possible to provide a developing apparatus which is excellent in environmental adaptability and can stably solve the problem of downstream concentrated toner image until the operational life of the developing apparatus.

Particularly, the occurrence of the downstream concentrated toner image can be prevented without causing a harmful image even in the nonmagnetic monocomponent noncontact developing scheme and without accelerating an occurrence of discharge phenomenon even in a low atmospheric pressure environment. When the jumping developer control member is caused to contact the image bearing member under pressure, it is possible to dispose the jumping developer control member so that its free end position is located in the developing zone with accuracy. Further, it is possible to prevent contamination of the jumping developer control member with toner, so that the downstream concentrated toner image is not caused to occur even when the developing operation is repetitively performed.

Further, in the present invention, the jumping developer control member is disposed in noncontact with the developer carrying member and is bent in a convex direction in correspondence with the surface shape of the developer carrying member to abut against the image bearing member. Further, the abutment portion between the jumping developer control member and the image bearing member and the free end of the jumping developer control member are located in the substantial developing zone. As a result, it becomes possible to increase a closest distance between the jumping developer control member and the developer carrying member, and it is possible to prevent current leakage from the developer carrying member to the photosensitive drum (image bearing member).

Further, in the present invention, the abutment portion between the jumping developer control member and the image bearing member is located on the upstream side from the closest portion between the image bearing member and the developer carrying member in the rotation direction of the image bearing member, and the closest distance between the jumping developer control member and the developer carrying member is larger than the closest distance between the image bearing member and the developer carrying member. As a result, it is possible to prevent the occurrence of current leakage in the jumping developer control member.

What is claimed is:

1. A developing apparatus, comprising:

a developer carrying member, disposed opposite to an image bearing member, for carrying developer which is caused to jump from said developer carrying member to said image bearing member to develop an electrostatic latent image formed on said image bearing member by creating an oscillation electric field between said image bearing member and said developer carrying member at an opposing portion where said image bearing member and said developer carrying member are opposed to each other; and a jumping developer regulation member for regulating an area in which the developer is caused to jump in the opposing portion, said jumping developer regulation member being extended from an upstream side of the opposing portion into a developing zone in a movement direction of said image bearing member, wherein said jumping developer regulation member is disposed apart from the developer carried by said developer carrying member and has an electrically insulated member, wherein said jumping developer regulation member is disposed in contact with a surface of said image bearing member under pressure, wherein said jumping developer regulation member is provided with an electrically insulated electroconductive member during development, and wherein when a developing zone between said image bearing member and said developer carrying member has a length L and a length from a position of an upstream end portion of said developing zone in a movement direction of said image bearing member to a position of a free end of said jumping developer regulation member is N, the lengths L and N satisfying the following relationship:

$$0.1 \leqq N/L \leqq 0.9.$$

2. An apparatus according to claim 1, wherein said jumping developer regulation member regulates the area, in which the developer is caused to jump, on an upstream side from the opposing portion in a movement direction of said image bearing member.

3. An apparatus according to claim 1, wherein when a developing zone between said image bearing member and said developer carrying member has a length L and a length from position of an upstream end portion of the developing zone in the movement direction of said image bearing member to a position of a free end of said jumping developer regulation member is N, the lengths L and N satisfy the following relationship:

$$0.3 \leqq L/N \leqq 0.6.$$

4. An apparatus according to claim 1, wherein the surface of said developer carrying member is convex in a direction, and said jumping developer regulation member is a flexible plate-like member and is disposed in contact with a surface of said image bearing member under pressure while being bent convexly in the direction.

5. An apparatus according to claim 4, wherein said plate-like member is disposed so that a closest distance between said plate-like member and said developer carrying member is longer than a closest distance between said image bearing member and said developer carrying member.

6. An apparatus according to claim 4, wherein said plate-like member is disposed so that a surface thereof abuts against said image bearing member.

7. An apparatus according to claim 1, wherein said jumping developer regulation member is a plate-like member and abuts against said image bearing member at an abutment portion located upstream from a closest portion between said image bearing member and said developer carrying member in the movement direction of said image bearing member, and a closest distance between said plate-like member and said developer carrying member is longer than a closest distance between said image bearing member and said developer carrying member.

8. An apparatus according to claim 1, wherein said jumping developer regulation member includes a free end located downstream from a portion where said developer regulation member is supported.

9. An apparatus according to claim 1, wherein said jumping developer regulation member has a width larger than a width of an image forming zone of said image bearing member in a longitudinal direction of said jumping developer regulation member.

10. An apparatus according to claim 2, wherein said image bearing member and said developer carrying member are rotatable in the opposing portion, and said jumping developer regulation member is disposed so as to cover the developer carried on said developer carrying member from a position with an angle of smaller than 30 degrees to a position with an angle of larger than 30 degrees in a direction opposite from a rotation direction of said developer carrying member when a position connecting a rotation center of said developer carrying member to a rotation center of said image bearing member is taken as 0 degrees.

11. An apparatus according to claim 9, wherein said jumping developer regulation member has an end portion in the longitudinal direction, the end portion being located outside the image forming zone and inside a developer carrying zone of said developer carrying member in the longitudinal direction.

12. An apparatus according to claim 9, wherein said jumping developer regulation member has an end portion in the longitudinal direction, the end portion having a shape bent toward said developer carrying member.

13. An apparatus according to claim 9, wherein said jumping developer regulation member has an end portion, in the longitudinal direction, located in contact with or close to a member for keeping a gap between said image bearing member and said developer carrying member at a constant value.

14. An apparatus according to claim 1, wherein said jumping developer regulation member is an elastic sheet member.

15. An apparatus according to claim 1, wherein the developer is a nonmagnetic monocomponent developer.

16. An apparatus according to claim 1, wherein said developing apparatus is provided together with said developer carrying member in a process cartridge detachably mountable to a main assembly of an image forming apparatus.

17. A developing apparatus, comprising:

a developer carrying member, disposed opposite to an image bearing member, for carrying developer which is caused to jump from said developer carrying member to said image bearing member to develop an electrostatic latent image formed on said image bearing member by creating an oscillation electric field between said image bearing member and said developer carrying member at an opposing portion where said image bearing member and said developer carrying member are opposed to each other; and a jumping developer regulation member for regulating an area in which the developer is caused to jump in the opposing portion, wherein said jumping developer regulation member is disposed apart from the developer carried by said developer carrying member and has an electrically floating member, which is electroconductive, and wherein the surface of said developer carrying member is convex in a direction, and said jumping developer regulation member is a flexible plate-like member and is disposed in contact with a surface of said image bearing member under pressure while being bent convexly in the direction.

18. An apparatus according to claim 17, wherein said jumping developer regulation member regulates the area, in which the developer is caused to jump, on an upstream side from the opposing portion in a movement direction of said image bearing member.

19. An apparatus according to claim 17, wherein when a developing zone between said image bearing member and said developer carrying member has a length L and a length from position of an upstream end portion of the developing zone in the movement direction of said image bearing member to a position of a free end of said jumping developer regulation member is N, the lengths L and N satisfying the following relationship:

$$0.3 \leqq L/N \leqq 0.6.$$

20. An apparatus according to claim 17, wherein said plate-like member is disposed so that a closest distance between said plate-like member and said developer carrying member is longer than a closest distance between said image bearing member and said developer carrying member.

21. An apparatus according to claim 17, wherein said jumping developer regulation member is a plate-like member and abuts against said image bearing member at an abutment portion located upstream from a closest portion between said image bearing member and said developer carrying member in a movement direction of said image bearing member, and a closest distance between said plate-like member and said developer carrying member is longer than a closest distance between said image bearing member and said developer carrying member.

22. An apparatus according to claim 17, wherein said jumping developer regulation member has a free end located downstream from a portion where is supported.

23. An apparatus according to claim 17, wherein said jumping developer regulation member has a width larger than a width of an image forming zone of said image bearing member in a longitudinal direction of said jumping developer regulation member.

24. An apparatus according to claim 18, wherein said image bearing member and said developer carrying member are rotatable in the opposing portion, and said jumping developer regulation member is disposed so as to cover the developer carried on said developer carrying member from a position with an angle of smaller than 30 degrees to a position with an angle of larger than 30 degrees in a direction opposite from a rotation direction of said developer carrying member when a position connecting a rotation center of said developer carrying member to a rotation center of said image bearing member is taken as 0 degrees.

25. An apparatus according to claim 23, wherein said jumping developer regulation member has an end portion in the longitudinal direction, the end portion being located outside the image forming zone and inside a developer carrying zone of said developer carrying member in the longitudinal direction.

26. An apparatus according to claim 23, wherein said jumping developer regulation member has an end portion in the longitudinal direction, the end portion having a shape bent toward said developer carrying member.

27. An apparatus according to claim 23, wherein said jumping developer regulation member has an end portion, in the longitudinal direction, located in contact with or close to a member for keeping a gap between said image bearing member and said developer carrying member at a constant value.

28. An apparatus according to claim 17, wherein said jumping developer regulation member is an elastic sheet member.

29. An apparatus according to claim 17, wherein the developer is a nonmagnetic monocomponent developer.

30. An apparatus according to claim 17, wherein said developing apparatus is provided together with said developer carrying member in a process cartridge detachably mountable to a main assembly of an image forming apparatus.

31. A developing apparatus, comprising:

a developer carrying member, disposed opposite to an image bearing member, for carrying developer which is caused to jump from said developer carrying member to said image bearing member to develop an electrostatic latent image formed on said image bearing member by creating an oscillation electric field between said image bearing member and said developer carrying member at an opposing portion where said image bearing member and said developer carrying member are opposed to each other; and a jumping developer regulation member for regulating an area in which the developer is caused to jump in the opposing portion, said jumping developer regulation member being extended from an upstream side of the opposing portion into a developing zone in a movement direction of said image bearing member, wherein said jumping developer regulation member is provided with an electrically insulated electroconductive member during development, wherein said jumping developer regulation member has a width larger than a width of an image forming zone of said image bearing member in a longitudinal direction of said jumping developer regulation member, and wherein said jumping developer regulation member is disposed in contact with a surface of said image bearing member under pressure.

32. An apparatus according to claim 31, wherein said jumping developer regulation member is provided with an insulating member which is in contact with said electroconductive member.

33. An apparatus according to claim 31, wherein said jumping developer regulation member regulates the area, in which the developer is caused to jump, on an upstream side from the opposing portion in a movement direction of said image bearing member.

34. An apparatus according to claim 33, wherein said image bearing member and said developer carrying member are rotatable in the opposing portion, and said jumping developer regulation member is disposed so as to cover the developer carried on said developer carrying member from a position with an angle of smaller than 30 degrees to a position with an angle of larger than 30 degrees in a direction opposite from a rotation direction of said developer carrying member when a position connecting a rotation center of said developer carrying member to a rotation center of said image bearing member is taken as 0 degrees.

35. An apparatus according to claim 31, wherein said jumping developer regulation member has an end portion in the longitudinal direction, the end portion being located outside the image forming zone and inside a developer carrying zone of said developer carrying member in the longitudinal direction.

36. An apparatus according to claim 31, wherein said jumping developer regulation member has an end portion in the longitudinal direction, the end portion having a shape bent toward said developer carrying member.

37. An apparatus according to claim 31, wherein said jumping developer regulation member has an end portion, in the longitudinal direction, located in contact with or close to a member for keeping a gap between said image bearing member and said developer carrying member at a constant value.

38. An apparatus according to claim 31, wherein said jumping developer regulation member is an elastic sheet member.

39. An apparatus according to claim 31, wherein the developer is a nonmagnetic monocomponent developer.

40. An apparatus according to claim 31, wherein said developing apparatus is provided together with said developer carrying member in a process cartridge detachably mountable to a main assembly of an image forming apparatus.

41. An apparatus according to claim 31, wherein said jumping developer regulation member is disposed apart from the developer carried by said developer carrying member.

42. A developing apparatus, comprising:

a developer carrying member, disposed opposite to an image bearing member, for carrying developer which is caused to jump from said developer carrying member to said image bearing member to develop an electrostatic latent image formed on said image bearing member by creating an oscillation electric field between said image bearing member and said developer carrying member at an opposing portion where said image bearing member and said developer carrying member are opposed to each other; and a jumping developer regulation member for regulating an area in which the developer is caused to jump in the opposing portion, said jumping developer regulation member being extended from an upstream side of the opposing portion into a developing zone in a movement direction of said image bearing member, wherein said jumping developer regulation member is disposed apart from the developer carried by said developer carrying member, wherein said jumping developer regulation member is an insulating member which is not provided with an electroconductive member, and wherein said jumping developer regulation member has a width larger than a width of an image forming zone of said image bearing member in a longitudinal direction of said jumping developer regulation member.

43. An apparatus according to claim 42, wherein said jumping developer regulation member regulates the area, in which the developer is caused to jump, on an upstream side from the opposing portion in a movement direction of said image bearing member.

44. An apparatus according to claim 42, wherein when a developing zone between said image bearing member and said developer carrying member has a length L and a length from a position of an upstream end portion of said developing zone in a movement direction of said image bearing member to a position of a free end of said jumping developer regulation member is N, the lengths L and N satisfy the following relationship:

$0.1 \leqq N/L \leqq 0.9$.

45. An apparatus according to claim 42, wherein when a developing zone between said image bearing member and said developer carrying member has a length L and a length from position of an upstream end portion of said developing zone in the movement direction of said image bearing member to a position of a free end of said jumping developer regulation member is N, the lengths Land N satisfy the following relationship:

$0.3 \leqq L/N \leqq 0.6$.

46. An apparatus according to claim 42, wherein said jumping developer regulation member is disposed in contact with a surface of said image bearing member under pressure.

47. An apparatus according to claim 42, wherein the surface of said developer carrying member is convex in a direction, and said jumping developer regulation member is a flexible plate-like member and is disposed in contact with a surface of said image bearing member under pressure while being bent convexly in the direction.

48. An apparatus according to claim 47, wherein the plate-like member is disposed so that a closest distance between said plate-like member and said developer carrying member is longer than a closest distance between said image bearing member and said developer carrying member.

49. An apparatus according to claim 47, wherein said plate-like member is disposed so that a surface thereof abuts against said image bearing member.

50. An apparatus according to claim 42, wherein said jumping developer regulation member is a plate-like member and abuts against said image bearing member at an abutment portion located upstream from a closest portion between said image bearing member and said developer carrying member in a movement direction of said image bearing member, and a closest distance between said plate-like member and said developer carrying member is longer than a closest distance between said image bearing member and said developer carrying member.

51. An apparatus according to claim 42, wherein said jumping developer regulation member has a free end located downstream from a portion where is supported.

52. An apparatus according to claim 43, wherein said image bearing member and said developer carrying member are rotatable in the opposing portion, and said jumping developer regulation member is disposed so as to cover the developer carried on said developer carrying member from a position with an angle of smaller than 30 degrees to a position with an angle of larger than 30 degrees in a direction opposite from a rotation direction of said developer carrying member when a position connecting a rotation center of said developer carrying member to a rotation center of said image bearing member is taken as 0 degrees.

53. An apparatus according to claim 42, wherein said jumping developer regulation member has an end portion in the longitudinal direction, the end portion being located outside the image forming zone and inside a developer carrying zone of said developer carrying member in the longitudinal direction.

54. An apparatus according to claim 42, wherein said jumping developer regulation member has an end portion in the longitudinal direction, the end portion having a shape bent toward said developer carrying member.

55. An apparatus according to claim 42, wherein said jumping developer regulation member has an end portion, in the longitudinal direction, located in contact with or close to a member for keeping a gap between said image bearing member and said developer carrying member at a constant value.

56. An apparatus according to claim 42, wherein said jumping developer regulation member is an elastic sheet member.

57. An apparatus according to claim 42, wherein the developer is a nonmagnetic monocomponent developer.

58. An apparatus according to claim 42, wherein said developing apparatus is provided together with said developer carrying member in a process cartridge detachably mountable to a main assembly of an image forming apparatus.

59. An apparatus according to claim 42, wherein said jumping developer regulation member is disposed apart from the developer carried by said developer carrying member.

60. A developing apparatus, comprising:

a developer carrying member, disposed opposite to an image bearing member, for carrying developer which is caused to jump from said developer carrying member to said image bearing member to develop an electrostatic latent image formed on said image bearing member by creating an oscillation electric field between said image bearing member and said developer carrying member at an opposing portion where said image bearing member and said developer carrying member are opposed to each other; and a jumping developer regulation member for regulating an area in which the developer is caused to jump in the opposing portion, said jumping developer regulation member being extended from an upstream side of the opposing portion into a developing zone in a movement direction of said image bearing member, wherein said jumping developer regulation member is an insulating member which is not provided with an electroconductive member, and wherein when a developing zone between said image bearing member and said developer carrying member has a length L and a length from a position of an upstream end portion of said developing zone in the movement direction of said image bearing member to a position of a free end of said jumping developer regulation member is N, the lengths L and N satisfy the following relationship:

$0.1 \leqq N/L \leqq 0.9$.

61. An apparatus according to claim 1, wherein when a developing zone between said image bearing member and said developer carrying member has a length L and a length from a position of an upstream end portion of said developing zone in the movement direction of said image bearing member to a position of a free end of said jumping developer regulation member is N, the lengths L and N satisfy the following relationship:

$0.1 \leqq N/L \leqq 0.9$.

62. An apparatus according to claim 1, wherein said jumping developer regulation member is provided with said electrically insulated member which is in contact with an electroconductive member.

63. An apparatus according to claim 17, wherein said jumping developer regulation member is provided with said insulating member which is in contact with an electroconductive member.

* * * * *

UNITED STATES PATENT AND TRADEMARK OFFICE

CERTIFICATE OF CORRECTION

PATENT NO. : 7,415,230 B2
APPLICATION NO. : 10/865759
DATED : August 19, 2008
INVENTOR(S) : Takeshi Kawamura et al.

It is certified that error appears in the above-identified patent and that said Letters Patent is hereby corrected as shown below:

TITLE PAGE ITEM [56] References Cited, FOREIGN PATENT DOCUMENTS:

"03194582 A" should read --03-194582 A--;
"06222658 A" should read --06-222658 A--;
"09106181 A" should read --09-106181 A--; and
"11223991 A" should read --11-223991 A--.

COLUMN 1:

Line 67, "an" should read --a--.

COLUMN 4:

Line 23, "explanatory" should read --explanatory view--.

COLUMN 5:

Line 36, "2 a a" should read --2 as a--.
Line 43, "bear" should read --bare--.

COLUMN 7:

Line 10, "B" should read --b--.
Line 64, "is" should read --in--.

COLUMN 11:

Line 49, "a" should read --as--.

COLUMN 14:

Line 27, "polypropyrene," should read --polypropylene,--.
Line 30, "has" should read --have--.
Line 39, "is suitably use" should read --it is suitable to use--.
Line 54, "end" should read --end and--.

COLUMN 15:

Line 2, "of" should read --the--.

COLUMN 17:

Line 44, "present" should read --present on--.
Line 56, "minutes" should read --minute--.
Line 61, "abut" should read --about--.

COLUMN 20:

Line 34, "was" should read --were--.

UNITED STATES PATENT AND TRADEMARK OFFICE

CERTIFICATE OF CORRECTION

PATENT NO. : 7,415,230 B2
APPLICATION NO. : 10/865759
DATED : August 19, 2008
INVENTOR(S) : Takeshi Kawamura et al.

It is certified that error appears in the above-identified patent and that said Letters Patent is hereby corrected as shown below:

COLUMN 22:
Line 58, “was occur” should read --occurred--.

COLUMN 23:
Line 50, “toner” should read --toner.--.
Line 51, “to an acceptable” should read --at an acceptable level. “x” represents an occurrence--.
Line 56, “thephotosensitive” should read --the photosensitive--.
Line 61, “ofthe” should read --of the--.

COLUMN 25:
Line 34, “THe” should read --The--.
Line 51, “preferably” should read --preferably be--.
Line 53, “preferable” should read --preferably--.

COLUMN 27:
Line 41, “can” should read --can be--.

COLUMN 28:
Line 21, “proton.” should read --portion.--.
Lines 24 and 25, should be merged into one paragraph.
Line 50, “preferably” should read --preferably be--.

COLUMN 32:
Line 35, “satisfying” should read --satisfy--.
Line 46, “position” should read --a position--.

COLUMN 34:
Line 19, “position” should read --a position--.
Line 22, “satisfying” should read --satisfy--.
Line 41, “has” should read --includes--.
Line 42, “where” should read --where said developer regulation member--.

UNITED STATES PATENT AND TRADEMARK OFFICE

CERTIFICATE OF CORRECTION

PATENT NO. : 7,415,230 B2
APPLICATION NO. : 10/865759
DATED : August 19, 2008
INVENTOR(S) : Takeshi Kawamura et al.

It is certified that error appears in the above-identified patent and that said Letters Patent is hereby corrected as shown below:

COLUMN 37:

Line 10, "Land" should read --L and--.
Line 42, "has" should read --includes--.
Line 43, "where" should read --where said developer regulation member--.

Signed and Sealed this

Seventeenth Day of February, 2009

JOHN DOLL
*Acting Director of the United States Patent and Trademark Office*